US008272077B2

(12) United States Patent
Hashimoto et al.

(10) Patent No.: US 8,272,077 B2
(45) Date of Patent: Sep. 25, 2012

(54) SANITARY WASHING APPARATUS

(75) Inventors: Hiroshi Hashimoto, Fukuoka-ken (JP); Minoru Sato, Fukuoka-ken (JP); Masayuki Mochita, Fukuoka-ken (JP); Akihiro Uemura, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 94 days.

(21) Appl. No.: 13/022,071

(22) Filed: Feb. 7, 2011

(65) Prior Publication Data

US 2011/0191951 A1 Aug. 11, 2011

(30) Foreign Application Priority Data

Feb. 9, 2010 (JP) ..... 2010-026830

(51) Int. Cl.
*A47K 3/20* (2006.01)

(52) U.S. Cl. ..... 4/443; 4/420.4

(58) Field of Classification Search ..... 4/420.1–420.5, 4/443–448

See application file for complete search history.

(56) References Cited

U.S. PATENT DOCUMENTS 6,795,981 B2 * 9/2004 Sato et al. ..... 4/420.4

FOREIGN PATENT DOCUMENTS

| | | | |
|---|---|---|---|
| JP | 3264274 | A | 12/2001 |
| JP | 2002-155567 | A | 5/2002 |
| JP | 2002-250071 | A | 9/2002 |
| JP | 2004-011251 | A | 1/2004 |
| JP | 2005-118761 | A | 5/2005 |

OTHER PUBLICATIONS

European Search Report for 11250137.4 dated Jun. 20, 2011.

* cited by examiner

*Primary Examiner* — Tuan N Nguyen
(74) *Attorney, Agent, or Firm* — Pearne & Gordon LLP

(57) ABSTRACT

A sanitary washing apparatus includes: a washing nozzle; and a pressurizing device. The sanitary washing apparatus that performs first and second jetting processes alternately jetted with a prescribed waiting time there between. The pressurizing device makes minimum pressure of water in the second jetting process higher than minimum pressure of water in the first jetting process and makes maximum pressure of water in the second jetting process higher than maximum pressure of water in the first jetting process so that the second water mass is faster than the first water mass. The prescribed waiting time between the first and the second jetting processes is set so that before the first water mass impinges on the human body, the second water mass having faster velocity than the first water mass overtakes the first water mass to enlarge jetting water cross-sectional area of the first water mass.

10 Claims, 9 Drawing Sheets

SANITARY WASHING APPARATUS

CROSS-REFERENCE TO RELATED APPLICATIONS

This application is based upon and claims the benefit of priority from the prior Japanese Patent Application No. 2010-026830, filed on Feb. 9, 2010; the entire contents of which are incorporated herein by reference.

BACKGROUND

1. Field of the Invention

Embodiments described herein relate generally relate to a sanitary washing apparatus.

2. Background Art

Sanitary washing apparatuses can clean the human private parts by washing with water. Hence, sanitary washing apparatuses are rapidly becoming popular.

In this context, a sanitary washing apparatus including a pressure generating section for causing a pulsating transition is proposed. In the pulsating transition, a pressure higher than the jetting pressure obtained from the supply water source is intermittently generated so as to achieve a comfortable feeling of washing even with a reduced amount of water used (see Japanese Patent No. 3264274).

This sanitary washing apparatus disclosed in Japanese Patent No. 3264274 can jet water with increased velocity and repeatedly pulsating flow by causing the pulsating transition of pressure.

Thus, after jetting, water portions with different velocities unite into a large jetting water group, which can be caused to impinge on the human private parts. More specifically, a water portion with fast velocity overtakes a water portion jetted earlier with slow velocity to form a large jetting water group. Although jetted in a small amount of water, a large jetting water group has been formed at the time of impingement on the human private parts. Thus, the disclosed technique is superior in being able to provide a comfortable feeling of washing even with a small amount of water.

However, the technique disclosed in Japanese Patent No. 3264274 has a problem of tradeoff between the feeling of stimulation (the feeling of being strongly washed by water with fast velocity) and the feeling of volume (the feeling of being washed by a large amount of water). Specifically, because velocity difference between jetting water portions is used to form a large jetting water group, the velocity of jetting water decreases. Hence, although the feeling of volume increases, the feeling of stimulation decreases. Conversely, if the feeling of stimulation is increased, the feeling of volume decreases. Thus, further improvement is desired to provide a greater feeling of washing. The inventors have been dedicated to research and development to provide a greater feeling of washing by a smaller amount of water.

On the other hand, the inventors have investigated such techniques as in JP-A 2002-155567 (Kokai) to realize a great feeling of washing with compatibility between the feeling of volume and the feeling of stimulation.

JP-A 2002-155567 (Kokai) discloses a sanitary washing apparatus in which water is squirted from an orifice section straight toward a jetting port, passes through an air intake section, and is jetted from the jetting port (see [Claim 1], paragraphs [0006] to [0014], FIG. 2, etc. in JP-A 2002-155567 (Kokai)).

In this sanitary washing apparatus disclosed in JP-A 2002-155567 (Kokai), the surface of continuously jetted water is disturbed by the air taken in by the jet flow due to the air intake effect (ejector effect) to form a thin portion and a thick portion in the water. In the portion where the water is thicker, in other words, where the water is denser, the jetting water causes the feeling of volume when impinging on the human private parts. Furthermore, because the water is squirted straight toward the jetting port from the orifice section for causing the ejector effect, it is possible to reduce energy loss due to collision of water with the nozzle inner wall surface, i.e., to suppress the decrease of the feeling of stimulation due to deceleration of water. As compared with conventional sanitary washing apparatuses based on continuous jetting, the technique is superior in being able to provide a great feeling of washing with compatibility between the feeling of volume and the feeling of stimulation.

However, in this technique disclosed in JP-A 2002-155567 (Kokai), a problem is that a large amount of water is required because of the configuration of continuous jetting. In addition, there is another problem with the size increase and cost of the apparatus because of the need of an apparatus for causing the ejector effect. Furthermore, in the configuration of this technique, the feeling of volume is created by generating disturbances in the surface of water by the ejector effect, and the feeling of stimulation is created by suppressing the velocity decrease of water obtained by the supply water pressure. Hence, there is a limit to increasing the contrast between the feeling of volume and the feeling of stimulation. Thus, improvement is desired also from the viewpoint of providing a feeling of washing at high level.

JP-A 2002-155567 (Kokai) also discloses a sanitary washing apparatus in which water is squirted from an orifice section straight toward a jetting port, passes through a resonance chamber, and is jetted from the jetting port (see [Claim 8], paragraphs [0026] to [0027], FIG. 13, etc. in JP-A 2002-155567 (Kokai)).

In this sanitary washing apparatus disclosed in JP-A 2002-155567 (Kokai), when water is squirted from the orifice section, a negative pressure occurs in the resonance chamber. Then, the water is attracted by the negative pressure of the resonance chamber to become jetting water with a conically expanding cross-sectional area. On the other hand, when the negative pressure in the resonance chamber exceeds a certain level, atmospheric air is sucked from the jetting port, and the pressure in the resonance chamber becomes positive. Then, the jetting water is jetted in a linear shape as it is squirted from the orifice section. When the jetting water with a conically expanding cross-sectional area impinges on the human private parts, the feeling of volume is produced. On the other hand, when the linear jetting water impinges on the human private parts, the feeling of stimulation is produced. The jetting water with a conically expanding cross-sectional area and the linear jetting water are alternately repeated. Thus, as compared with conventional sanitary washing apparatuses based on continuous jetting, the technique is superior in being able to provide a great feeling of washing with compatibility between the feeling of volume and the feeling of stimulation.

However, in this technique disclosed in JP-A 2002-155567 (Kokai), a problem is that a large amount of water is required because of the configuration of continuous jetting. Furthermore, in the configuration of this technique, the feeling of volume is created by expanding the cross-sectional area of water by the negative pressure of the resonance chamber, and the feeling of stimulation is created by suppressing the velocity decrease of water obtained by the supply water pressure. Hence, there is a limit to increasing the contrast between the feeling of volume and the feeling of stimulation. Thus, improvement is desired also from the viewpoint of providing a feeling of washing at high level.

SUMMARY

According to an aspect of the invention, there is provided a sanitary washing apparatus configured to jet supplied water toward a human body, including: a washing nozzle including a jetting port configured to jet the water toward the human body; and a pressurizing device configured to pressurize the water and jet it from the jetting port, the sanitary washing apparatus being configured to perform a first jetting process having a first time span and a second jetting process having a second time span, jetting water by the first jetting process and jetting water by the second jetting process being alternately jetted from the jetting port, after performing the first jetting process, a prescribed waiting time being provided before performing the second jetting process, in the first jetting process, the pressurizing device making pressure of water subsequently jetted during the first time span higher than pressure of water previously jetted in the first jetting process so that the water subsequently jetted during the first time span overtakes and unites with the water previously jetted in the first jetting process at a prescribed position from the jetting port to form a first water mass, in the second jetting process, the pressurizing device making pressure of water subsequently jetted during the second time span higher than pressure of water previously jetted in the second jetting process so that the water subsequently jetted during the second time span overtakes and unites with the water previously jetted in the second jetting process at a prescribed position from the jetting port to form a second water mass, the pressurizing device making minimum pressure of water in the second jetting process higher than minimum pressure of water in the first jetting process and making maximum pressure of water in the second jetting process higher than maximum pressure of water in the first jetting process so that the second water mass is faster than the first water mass, and the prescribed waiting time between the first jetting process and the second jetting process being set so that before the first water mass impinges on the human body, the second water mass having faster velocity than the first water mass overtakes the first water mass to enlarge jetting water cross-sectional area of the first water mass.

DETAILED DESCRIPTION

Figure 1:
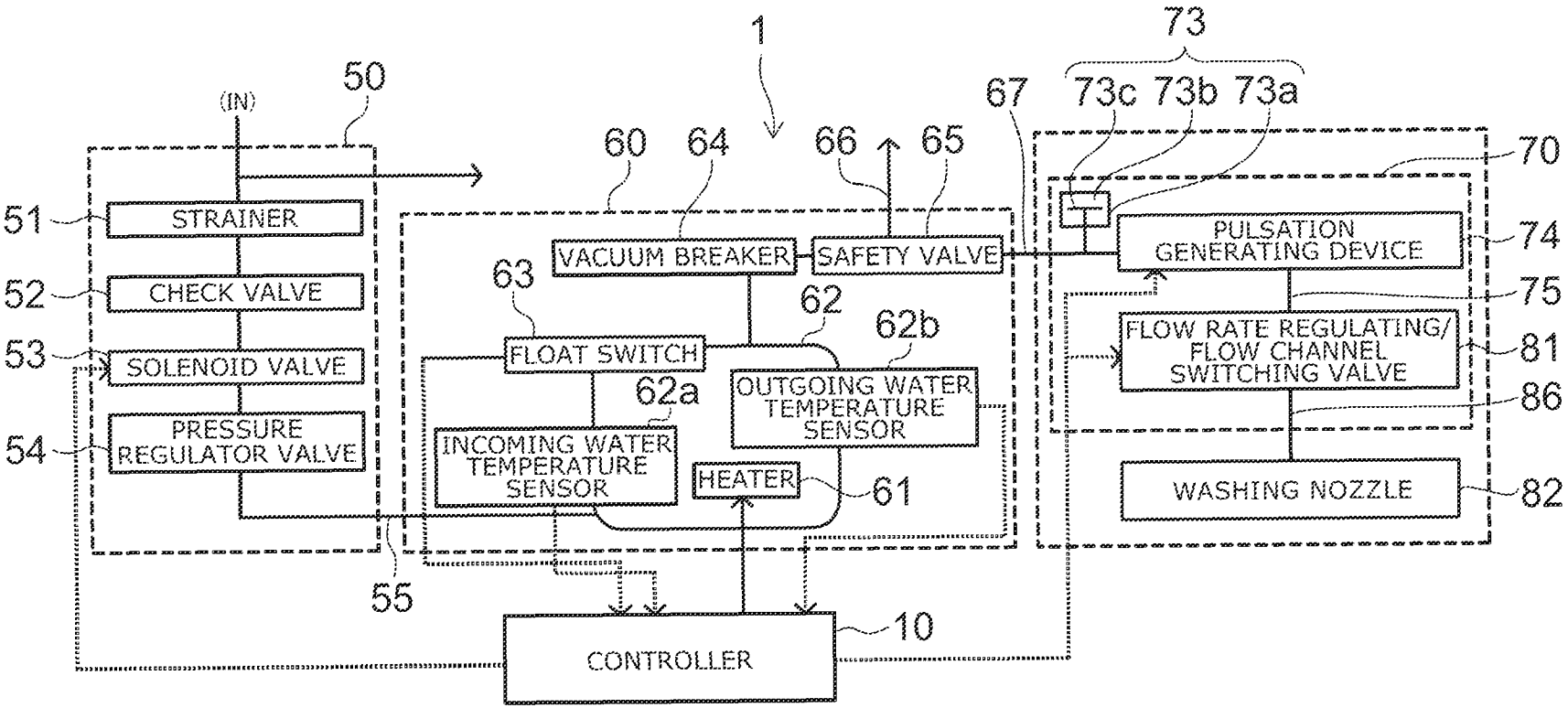
FIG. 1 is a block diagram showing the schematic configuration of a sanitary washing apparatus according to an embodiment of the invention, focusing on its water channel system.

The first invention is a sanitary washing apparatus configured to jet supplied water toward a human body, including: a washing nozzle including a jetting port configured to jet the water toward the human body; and a pressurizing device configured to pressurize the water and jet it from the jetting port, the sanitary washing apparatus being configured to perform a first jetting process having a first time span and a second jetting process having a second time span, jetting water by the first jetting process and jetting water by the second jetting process being alternately jetted from the jetting port, after performing the first jetting process, a prescribed waiting time being provided before performing the second jetting process, in the first jetting process, the pressurizing device making pressure of water subsequently jetted during the first time span higher than pressure of water previously jetted in the first jetting process so that the water subsequently jetted during the first time span overtakes and unites with the water previously jetted in the first jetting process at a prescribed position from the jetting port to form a first water mass, in the second jetting process, the pressurizing device making pressure of water subsequently jetted during the second time span higher than pressure of water previously jetted in the second jetting process so that the water subsequently jetted during the second time span overtakes and unites with the water previously jetted in the second jetting process at a prescribed position from the jetting port to form a second water mass, the pressurizing device making minimum pressure of water in the second jetting process higher than minimum pressure of water in the first jetting process and making maximum pressure of water in the second jetting process higher than maximum pressure of water in the first jetting process so that the second water mass is faster than the first water mass, and the prescribed waiting time between the first jetting process and the second jetting process being set so that before the first water mass impinges on the human body, the second water mass having faster velocity than the first water mass overtakes the first water mass to enlarge jetting water cross-sectional area of the first water mass.

In the configuration of this invention, the first jetting process for forming a first water mass using the velocity difference at jetting time and the second jetting process for forming a second water mass using the velocity difference at jetting time are alternately performed. Furthermore, after performing the first jetting process, a prescribed waiting time is provided before performing the second jetting process. Thus, after jetting, the first water mass and the second water mass are separately formed. Furthermore, in this configuration, the minimum pressure of water in the second jetting process is made higher than the minimum pressure of water in the first jetting process, and the maximum pressure of water in the second jetting process is made higher than the maximum pressure of water in the first jetting process. Thus, the velocity of the second water mass is faster than the velocity of the first water mass. That is, the first water mass is formed as a "jetting water group with slow velocity (slow ball)", and the second water mass is separately formed as a "jetting water group with fast velocity (fast ball)".

Furthermore, in this invention, the waiting time provided to separately form the first water mass and the second water mass is set so that the second water mass overtakes the first water mass before impinging on the private parts. By the second water mass (fast ball) overtaking the first water mass (slow ball), the slow ball receives impact from the fast ball. This impact force enlarges the jetting water cross-sectional area of the slow ball. The slow ball with an enlarged jetting water cross-sectional area impinges on the human body. Hence, the impingement cross-sectional area is also large. Thus, the human feels as if a large amount of water impinges with a large cross-sectional area (the feeling of volume).

On the other hand, after overtaking the first water mass (slow ball), the second water mass (fast ball) impinges on the human body with relatively fast velocity even after overtaking the first water mass, because the first water mass and the second water mass are separately formed. Hence, the human feels as if being strongly washed with water having fast velocity (the feeling of stimulation). Thus, in this technique, the jetting water cross-sectional area of the slow ball is enlarged by the impact force by the fast ball overtaking the slow ball. By using this technique, a larger jetting water cross-sectional area can be formed than in the conventional technique for enlarging the jetting water cross-sectional area using overtaking by continuous velocity increase. This can realize washing with compatibility between the feeling of stimulation and the feeling of volume even with a smaller amount of water than conventional. With the same amount of water as conventional, washing with compatibility between the feeling of stimulation and the feeling of volume can be realized with a greater feeling of volume.

The term "alternately jetted" used herein is not limited to jetting in which the first jetting water and the second jetting water are jetted completely in turns, but any jetting in which the first jetting water or the second jetting water is jetted between the first jetting water and the second jetting water is also expressed as "alternate".

The second invention is the sanitary washing apparatus according to the first invention, wherein the pressurizing device varies the pressure of the water so that amount of overtaking by which the previously jetted water is overtaken by the subsequently jetted water in the first jetting process is larger than the amount of overtaking in the second jetting process at the prescribed position from the jetting port.

In this sanitary washing apparatus, the amount of overtaking in the first jetting process is made larger than the amount of overtaking in the second jetting process. Hence, the first water mass (slow ball) can be formed in a larger size than the second water mass (fast ball). Thus, by previously forming a slow ball as a water mass with a large diameter, the jetting water cross-sectional area after the collision of the fast ball with the slow ball can be formed in a larger size. This can realize washing with a greater feeling of volume.

The third invention is the sanitary washing apparatus according to the first invention, wherein pressure increment of the water per unit time in the second jetting process is larger than pressure increment of the water per unit time in the first jetting process.

In this sanitary washing apparatus, in the second jetting process, the pressure of water is increased relatively rapidly. Hence, the velocity (initial velocity) of water jetted from the jetting port increases relatively rapidly. Thus, a large amount of overtaking can be ensured in the second jetting process, and the second water mass can be formed in a large size. Hence, the fast ball can collide with the slow ball with a sufficient impact force, and the cross-sectional area of the slow ball can be enlarged more significantly.

On the other hand, in the first jetting process, the pressure of water is increased relatively slowly. Hence, the velocity (initial velocity) of water jetted from the jetting port increases relatively slowly. Thus, a large amount of overtaking can be ensured in the first jetting process, and the first water mass can be formed in a large size. Hence, the cross-sectional area of the slow ball after collision with the fast ball is also made larger. Thus, the feeling of washing with a great feeling of volume can be obtained.

The fourth invention is the sanitary washing apparatus according to the first invention, wherein pressure increment of the water per unit time in second half of the first jetting process is larger than pressure increment of the water per unit time in first half of the first jetting process.

In this sanitary washing apparatus, with the increase of the initial velocity of water jetted from the jetting port, the rate of increase of the initial velocity is also increased. This can further increase the amount of overtaking by which the subsequently jetted water overtakes the previously jetted water. That is, the first water mass can be formed in a larger size. Hence, the cross-sectional area of the slow ball after collision with the fast ball is also made larger. Thus, the feeling of washing with a great feeling of volume can be obtained.

The fifth invention is the sanitary washing apparatus according to the first invention, wherein in at least part of the first jetting process, the water is jetted from the jetting port in a pressure region below supply water pressure.

In this sanitary washing apparatus, generation of the slow ball is performed in a pressure region below the supply water pressure. As a result, the initial velocity itself of water jetted from the jetting port is slow. Then, the time from when the jetting water is jetted from the jetting port by the first jetting process until impinging on the human body is made longer than in the case of fast initial velocity. Hence, more water is likely to overtake and unite. Thus, when the fast ball collides with the slow ball, the cross-sectional area of the slow ball can be enlarged more significantly.

The sixth invention is the sanitary washing apparatus according to the fifth invention, wherein in at least part of the second jetting process, the water is jetted from the jetting port in a pressure region above the supply water pressure.

In this sanitary washing apparatus, generation of the fast ball is performed in a pressure region above the supply water pressure. As a result, the initial velocity itself of water jetted from the jetting port is fast. This can increase the impact force in the collision of the fast ball with the slow ball. Thus, the cross-sectional area of the slow ball can be enlarged more significantly.

The seventh invention is the sanitary washing apparatus according to the fifth invention, wherein the pressurizing device includes: a pressurizer configured to apply pressure to the water; and a pressure accumulator provided between the pressurizer and the jetting port and configured to accumulate the pressure of the water. Part of the pressure applied to the water by the pressurizer in the second jetting process is accumulated in the pressure accumulator, and the accumulated pressure is applied to the water in the first jetting process.

In the configuration of this sanitary washing apparatus, in the second jetting process for jetting with faster velocity, the pressurizer is activated to form a second water mass, and part of the pressure is accumulated in the pressure accumulator. By releasing the accumulated pressure, the water is pressurized to form a first water mass in the first jetting process. Hence, the pressure region below the supply water pressure can be easily formed. Furthermore, in the pressurization by releasing the accumulated pressure, the pressurizing force gradually increases. Hence, in the first process, the pressurizing force increases with the increase of pressure, i.e., initial velocity. This can further increase the amount of overtaking by which the subsequently jetted water overtakes the previously jetted water. Thus, the second water mass can be formed in a larger size.

The eight invention is the sanitary washing apparatus according to the fourth invention, wherein the pressurizing device includes: a pressurizer configured to apply pressure to the water; and a pressure accumulator provided between the pressurizer and the jetting port and configured to accumulate the pressure of the water. In the first jetting process, at beginning of jetting, the pressure accumulator applies the pressure to the water, and in second half of the first time span in the first jetting process, the pressurizer applies the pressure to the water.

In this sanitary washing apparatus, in the first jetting process, at the beginning, the initial velocity of water jetted from the jetting port is increased by pressurization by the pressure accumulator. When the initial velocity becomes fast, the pressurization by the pressurizer is added to raise the rate of increase of the initial velocity. Thus, in the first jetting process, this can further increase the amount of overtaking by which the subsequently jetted water overtakes the previously jetted water. That is, the first water mass can be formed in a larger size. Thus, the feeling of washing with a great feeling of volume can be obtained.

The ninth invention is the sanitary washing apparatus according to the first invention, wherein the first jetting process and the second jetting process jet water from the single jetting port.

In this sanitary washing apparatus, the jetting water by the first jetting process and the jetting water by the second jetting process are jetted from the same jetting port. Thus, the first water mass and the second water mass travel coaxially. Hence, there is no misalignment when the second water mass overtakes the first water mass. Thus, the second water mass is caused to reliably collide with the first water mass so that the jetting water cross-sectional area of the first water mass can be enlarged.

The tenth invention is the sanitary washing apparatus according to the first invention, wherein the prescribed waiting time is set so that the water subsequently jetted by the second jetting process outstrips the water previously jetted by the first jetting process before impinging on the human body.

In this sanitary washing apparatus, the second water mass (fast ball) overtakes the first water mass (slow ball), and the jetting water cross-sectional area of the slow ball is enlarged. Furthermore, the fast ball outstrips the slow ball. Hence, the slow ball receives a larger impact force from the fast ball. By the impact force, the jetting water cross-sectional area of the slow ball is made even larger than in the case where the fast ball overtakes the slow ball. This can realize washing with a greater feeling of volume. Furthermore, the fast ball impinges on the human private parts earlier than the slow ball without being absorbed by the slow ball. Hence, the fast ball impinges on the human private parts without attenuation of the feeling of stimulation of the fast ball. This can realize washing in which the feeling of volume and the feeling of stimulation are further enhanced.

Embodiments of the invention will now be described with reference to the drawings. In the drawings, similar components are labeled with like reference numerals, and the detailed description thereof is omitted as appropriate.

FIG. 1 is a block diagram showing the schematic configuration of a sanitary washing apparatus according to an embodiment of the invention, focusing on its water channel system.

As shown in FIG. 1, the water channel system of the sanitary washing apparatus 1 includes a water inlet side valve unit 50 supplied with water from a supply source (not shown) external to the casing of the sanitary washing apparatus 1, a heat exchange unit 60, and a pulsation generating unit (pressurizing device) 70. That is, a water inlet side valve unit 50, a heat exchange unit 60, and a pulsation generating unit 70 are provided in the water channel system of the sanitary washing apparatus 1 sequentially from the side of the supply source (not shown) external to the casing of the sanitary washing apparatus 1.

Water imparted with pulsation by the pulsation generating unit 70 is guided from the pulsation generating unit 70 to a washing nozzle 82, and jetted from the nozzle 82. These units are each housed in the casing of the sanitary washing apparatus 1. A solenoid valve 53, an incoming water temperature sensor 62*a*, a heater 61, an outgoing water temperature sensor 62*b*, a float switch 63, a pulsation generating device (pressurizer) 74, a flow rate regulating/flow channel switching valve 81, a washing nozzle 82, and control buttons (not shown) are connected to a controller 10. The control buttons include a washing button for selecting one of the washing modes of "bottom hard wash" with a strong feeling of stimulation, "bottom soft wash" (hereinafter referred to as "gentle wash"), and "bidet wash", a water strength change button for changing the water strength of water, a temperature adjustment button by which the temperature of water can be selected, and a stop button for stopping washing.

These units are each connected by a supply water conduit across the pulsation generating unit 70. More specifically, the water inlet side valve unit 50 and the heat exchange unit 60 are connected by a supply water conduit 55.

The water inlet side valve unit 50 is directly supplied with water (e.g., tap water) from a supply water source (e.g., water pipe). Dust and the like in this water guided to the water inlet side valve unit 50 are trapped by a strainer 51 of the water inlet side valve unit 50, and the water flows into a check valve 52. When the conduit is opened by the solenoid valve 53, the water flows into a pressure regulator valve 54. Then, with the pressure regulated to a prescribed pressure (e.g., a supply water pressure of 0.110 MPa), the water flows into the heat exchange unit 60 of the instantaneous heating type. The flow rate of water flowing in under such pressure regulation is set to approximately 200 to 600 cc/min. Here, alternatively, a pipe from a flush water tank (not shown) storing flush water for flushing the toilet bowl can be branched to the water inlet side valve unit 50.

The heat exchange unit 60 downstream of the aforementioned water inlet side valve unit 50 includes a heat exchanger 62 with a heater 61 incorporated therein. While this heat exchange unit 60 uses the incoming water temperature sensor 62*a* and the outgoing water temperature sensor 62*b* to detect the temperature of water flowing into the heat exchanger 62 and the temperature of water flowing out of the heat exchanger 62, the heat exchange unit 60 uses the detected temperature to control the heating operation of the heater 61 so that the water is heated to a preset temperature of water. That is, in the heat exchange unit 60, heating by the heater 61 is performed so that the temperature of water is set to a prescribed preset temperature. Here, the heating operation of the heater 61 is controlled by the controller 10 based on the detected temperature from the incoming water temperature sensor 62*a* and the detected temperature from the outgoing water temperature sensor 62*b* so that the temperature of water is set to a prescribed preset temperature.

Then, the water thus heated flows into the pulsation generating unit 70 described below, is imparted with pulsation, and then flows into the washing nozzle 82. Here, pulsation means pressure variation caused by the pulsation generating unit, and a device or the like causing pressure variation is referred to as pulsation generating unit.

Furthermore, this heat exchange unit 60 includes a float switch 63 for detecting the water level in the heat exchanger 62. This float switch 63 is configured so as to output a signal indicating that the water level is equal to or higher than a prescribed water level at which the heater 61 is submerged. The controller 10 controls energization of the heater 61 while monitoring input of this signal. Hence, energization of the heater 61 not submerged, i.e., the so-called boil-dry of the heater 61, can be prevented. Here, the heater 61 of the heat exchange unit 60 is optimally controlled by combination of feedforward control and feedback control in the controller 10.

Furthermore, this heat exchange unit 60 includes a vacuum breaker 64 and a safety valve 65 at the water outlet from the heat exchanger 62, i.e., at the junction of the heat exchanger with the conduit downstream of the heat exchanger 62. The vacuum breaker 64 introduces atmospheric air into the conduit under negative pressure to break water in the conduit downstream of the heat exchanger and prevent backflow of water from the downstream side of the heat exchanger. That is, the vacuum breaker 64 introduces atmospheric air into the conduit under negative pressure so that water in the conduit downstream of the heat exchanger is ejected from the washing nozzle 82. Thus, even if the pressure in the conduit becomes negative, it is possible to prevent backflow of water from the downstream side of the heat exchanger to the heat exchanger 62. Furthermore, when the water pressure in the supply water conduit 67 exceeds a prescribed value, the safety valve 65 opens and ejects water to a wastewater piping 66. This prevents malfunctions such as damage to apparatuses and hose disengagement under abnormal conditions.

Next, the structure of the pressure generating device 74 is illustrated.

Figure 2:
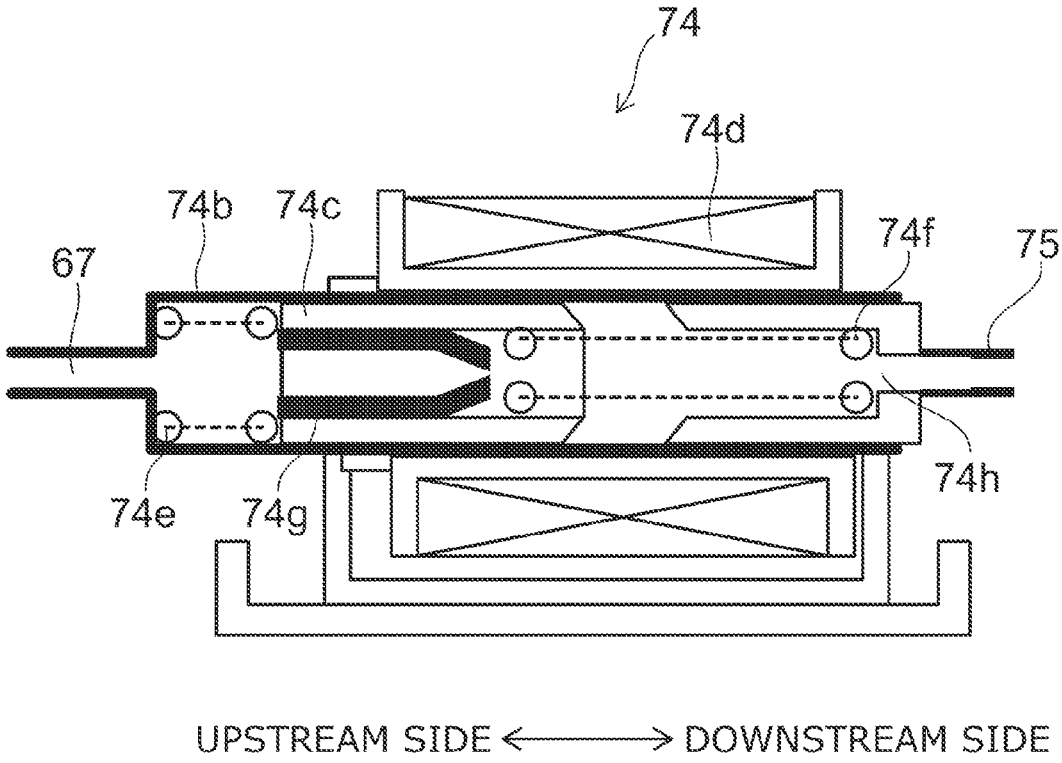
FIG. 2 is a schematic configuration cross-sectional view of a pulsation generating device.

FIG. 2 is a schematic configuration cross-sectional view of the pulsation generating device 74.

As shown in FIG. 2, the pulsation generating device 74 includes a cylinder 74*b* connected to the supply water conduits 67 and 75, a plunger 74*c* movably provided inside the cylinder 74*b*, a check valve 74*g* provided inside the plunger 74*c*, and a pulsation generating coil 74*d* for moving the plunger 74*c* forward and backward under control of an exciting voltage. The check valve is disposed so that the pressure of water increases when the position of the plunger 74*c* is changed to the washing nozzle side (downstream side), and that the pressure of water decreases when it is changed to the side (upstream side) opposite to the washing nozzle.

This plunger 74*c* is moved to the upstream or downstream side by controlling the excitation of the pulsation generating coil 74*d*. That is, to add pulsation to water (to cause pressure variation in water), the plunger 74*c* is moved forward and backward in the axial direction (upstream direction and downstream direction) of the cylinder 74*b* by controlling the exciting voltage passed in the pulsation generating coil 74*d*.

Here, by excitation of the pulsation generating coil 74*d*, the plunger 74*c* moves from the original position (plunger original position) as shown to the downstream side 74*h*. Then, when the excitation of the coil is extinguished, it returns to the original position by the biasing force of a return spring 74*f*. Here, a buffer spring 74*e* buffers the return motion of the plunger 74*c*. The plunger 74*c* includes a duckbill check valve 74*g* to prevent backflow to the upstream side. Hence, at the time of motion from the plunger original position to the downstream side, the plunger 74*c* can pressurize water in the cylinder 74*b* and drive it to the supply water conduit 75. Here, because the plunger original position and the position after the motion to the downstream side are always the same, the amount of water fed to the supply water conduit 75 in response to the motion of the plunger 74*c* is constant.

Subsequently, at the time of return to the original position, water flows into the cylinder 74*b* through the check valve 74*g*. Thus, at the next time when the plunger 74*c* moves to the downstream side, a constant amount of water is newly fed to the supply water conduit 75.

Here, the pulsation generating device 74 is supplied with the water at the aforementioned supply water pressure through the supply water conduit 67. Hence, as described above, the water poured into the cylinder 74*b* through the check valve 74*g* during the return of the plunger 74*c* to the original position is fed to the supply water conduit 75, although the primary pressure is not maintained due to the effect of pressure loss caused by the check valve 74*g* and drag-in of water on the downstream side. That is, the water poured into the cylinder 74*b* through the check valve 74*g* during the return of the plunger 74*c* to the original position flows out toward the supply water conduit 75. Here, the pressure of water flowing out to the supply water conduit 75 is different from the primary pressure (the aforementioned supply water pressure) due to the effect of pressure loss caused by the check valve 74*g* and drag-in of water on the downstream side.

This situation is shown in the figure.

Figure 3:
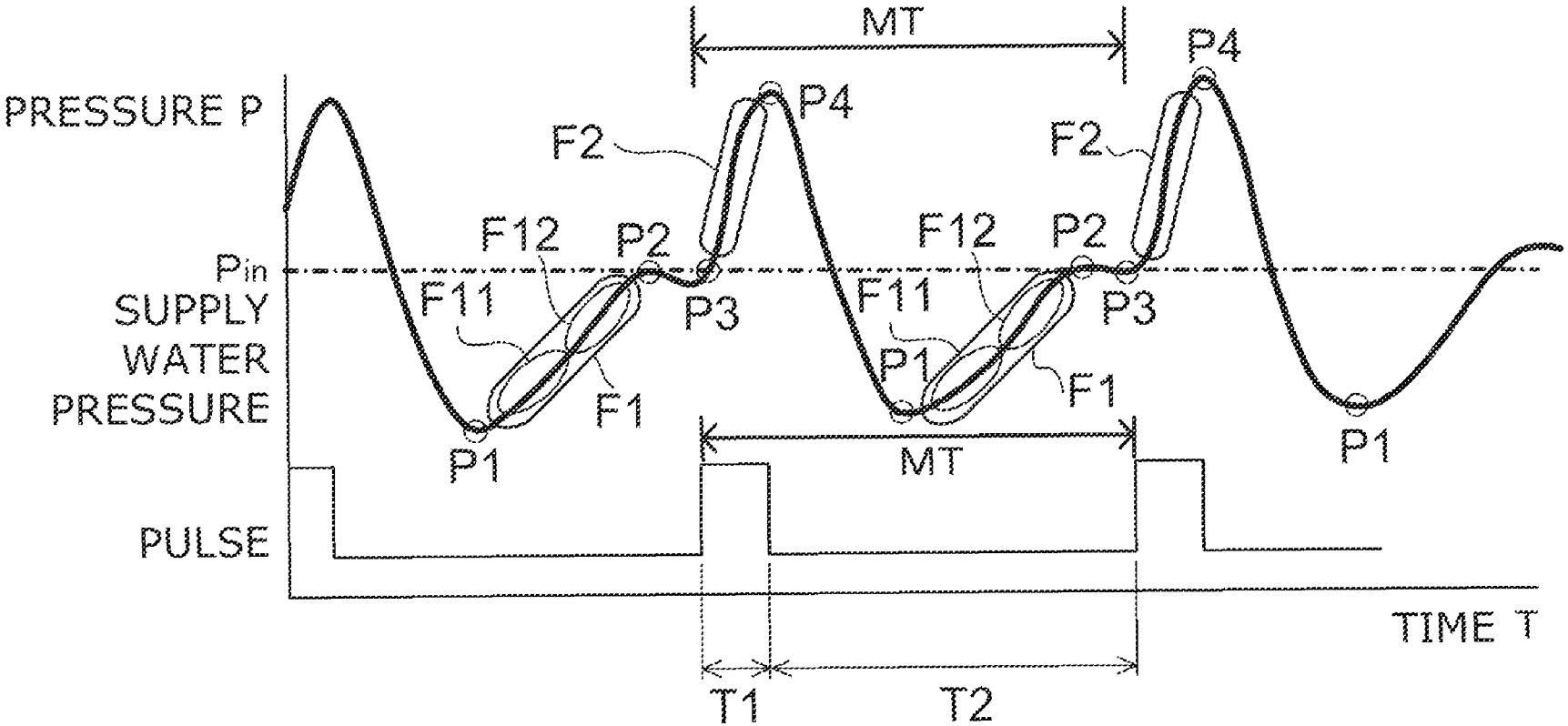
FIG. 3 is a schematic view for illustrating the pressure variation of water and the excitation of a pulsation generating coil of the pulsation generating device for generating pulsation in jetting water.

FIG. 3 is a schematic view for illustrating the pressure variation of water and the excitation of the pulsation generating coil 74*d* of the pulsation generating device 74 for generating pulsation in jetting water.

Here, the upper row of FIG. 3 is a schematic view for illustrating the pressure variation of water. The lower row of FIG. 3 is a voltage waveform showing the excitation of the pulsation generating coil 74*d* of the pulsation generating device 74 for generating pulsation in jetting water (a schematic view for illustrating the voltage waveform applied to the pulsation generating coil 74*d*).

As shown in FIG. 3, under the pressure pulsating with reference to the introduced water pressure Pin (supply water pressure) for introduction into the pulsation generating device 74, water is fed from the pulsation generating device 74 to the supply water conduit 75, and then to the washing nozzle 82, and jetted toward the human private parts.

Next, a water hammer reduction accumulator 73 is illustrated. The water hammer reduction accumulator 73 includes a housing 73*a*, a damper chamber 73*b* in the housing, and a damper 73*c* placed in this damper chamber.

The water hammer reduction accumulator 73 thus configured reduces, by the action of the damper 73*c*, water hammer applied to the supply water conduit 67 on the upstream side of the pulsation generating unit 70. This can alleviate the effect of water hammer exerted on the water temperature distribution in the heat exchanger 62, and stabilize the temperature of water. Here, preferably, the water hammer reduction accumulator 73 is placed close to the pulsation generating device 74 or placed integrally with the device 74 from the viewpoint of being able to rapidly and effectively avoid the propagation of pulsation generated in the pulsation generating device 74 to the upstream side. That is, it is preferable that the water hammer reduction accumulator 73 be placed close to the pulsation generating device 74 or that the water hammer reduction accumulator 73 be integrated with the pulsation generating device 74. Then, it is possible to rapidly and effectively suppress the propagation of pulsation generated in the pulsation generating device 74 to the upstream side.

Next, the flow rate regulating/flow channel switching valve 81 is illustrated. The washing nozzle 82 is connected to the flow rate regulating/flow channel switching valve 81 through a supply water conduit 86. The supply destination of water fed from the pulsation generating device 74 is switched among the flow channels 83, 84, and 85 (see FIG. 4A and FIG. 4B) of the washing nozzle 82, and the flow rate thereof is regulated. That is, the flow rate regulating/flow channel switching valve 81 switches the flow channel so that water fed from the pulsation generating device 74 is supplied to one of the flow channels 83, 84, and 85 provided in the washing nozzle 82. Furthermore, at this time, the flow channel cross-sectional area is adjusted for flow rate regulation.

Figure 4A:
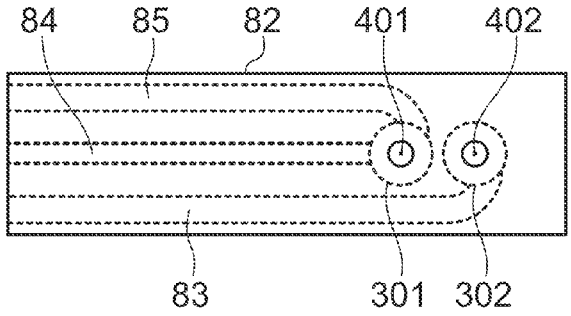
FIG. 4A and FIG. 4B are schematic views for illustrating a washing nozzle.
Figure 4B:
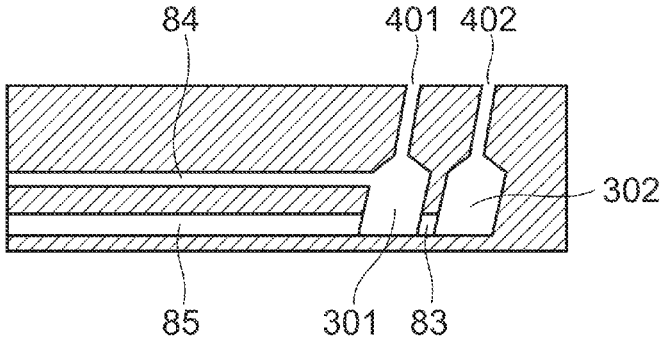

Next, the washing nozzle 82 is illustrated. FIGS. 4A and 4B show structural views of the washing nozzle. A plurality of washing flow channels 83, 84, and 85 located in the washing nozzle 82 communicate with a jetting port 401 for bottom wash configured to jet water toward the "bottom" (human private parts) and a jetting port 402 for bidet wash, each located near the tip of the washing nozzle. Water vortex chambers 301 and 302 are provided upstream of the jetting ports 401 and 402 so that water passed through the washing flow channels 83 and 85 is swirled and jetted from the jetting ports as swirling flows.

That is, a jetting port 401 for bottom wash configured to jet water toward the "bottom" (human private parts) and a jetting port 402 for bidet wash are provided near the tip of the washing nozzle 82. The water vortex chamber 301 is provided on the upstream side of the jetting port 401 so as to communicate therewith. The water vortex chamber 302 is provided on the upstream side of the jetting port 402 so as to communicate therewith.

The washing flow channel 83 is connected tangentially to the water vortex chamber 302 shaped like a cylinder. The washing flow channel 85 is connected tangentially to the water vortex chamber 301 shaped like a cylinder. The washing flow channel 84 is connected to the water vortex chamber 301 toward its axial center. The water passed in the tangential direction swirls along the inner wall of the water vortex chamber 301, 302, and the swirled water is jetted from the jetting port 401, 402 as a swirling flow.

Here, the washing flow channel 84 communicates with the upper side of the water vortex chamber 301 and communicates with the jetting port 401. That is, the washing flow channel 83 is connected to the lower portion of the water vortex chamber 302. The washing flow channel 84 is connected to the upper portion of the water vortex chamber 301, and the washing flow channel 85 is connected to the lower portion of the water vortex chamber 301.

The diameter of the jetting port 401, 402 is in the approximate range from 0.5 mm to 1.8 mm, and an optimal diameter is selected depending on the flow rate. For instance, for a flow rate of 430 ml/min, the diameter of the jetting port 401 for bottom wash is set to approximately 0.9 mm, and the diameter of the jetting port 402 for bidet wash is set to approximately 1.4 mm.

Here, jetting of water in this embodiment is illustrated.

Figure 5:
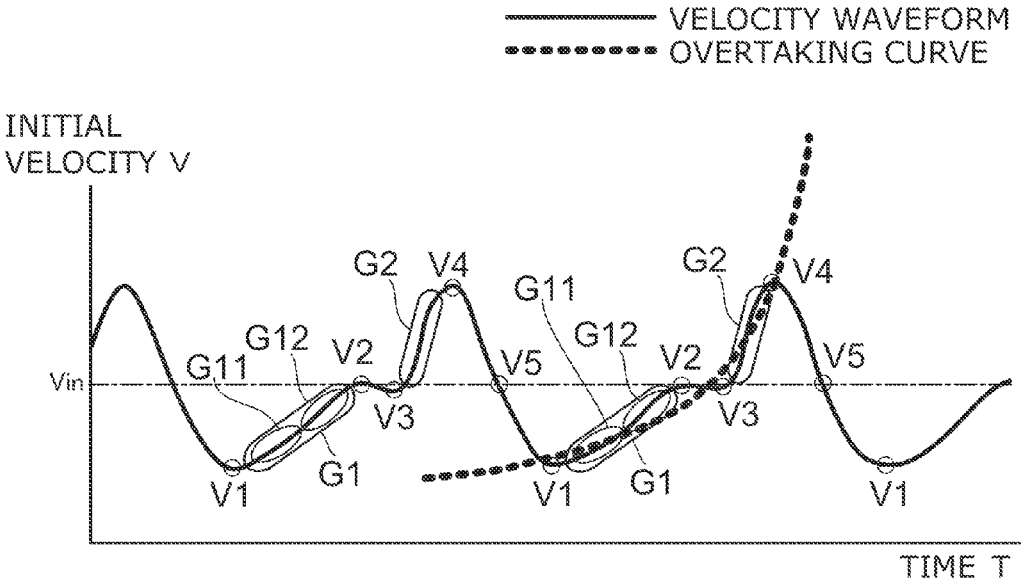
FIG. 5 is a timing chart showing the velocity (initial velocity) of water flowing out of the pulsation generating device.

FIG. 5 is a timing chart showing the velocity (initial velocity) of water flowing out of the pulsation generating device 74.

To excite the pulsation generating coil 74*d* to generate pulsation in the pulsation generating device 74, the controller 10 outputs a pulse-like signal. This pulse signal is outputted to a switching transistor (not shown) connected to the pulsation generating coil 74*d* and configured to turn it on. That is, a switching transistor (not shown) for opening/closing the circuit is connected to the pulsation generating coil 74*d*. The pulse signal outputted from the controller 10 is inputted to the switching transistor.

Hence, the pulsation generating coil 74*d* repeats excitation by turning on/off of the switching transistor in accordance with the pulse signal, and periodically reciprocates (moves forward and backward) the plunger 74*c* as described above. That is, the opening/closing operation (on/off operation) of the switching transistor based on the inputted pulse signal repetitively excites the pulsation generating coil 74*d*. Furthermore, by repetitively exciting the pulsation generating coil 74*d*, the plunger 74*c* is periodically reciprocated (moved forward and backward).

Thus, water is supplied from the pulsation generating device 74 to the jetting port 401 in the state of pulsating flow with the pressure periodically varied up and down. This pulsating flow of water is jetted from each jetting port.

Here, the pulse-like voltage applied to the pulsation generating coil 74*d* is illustrated in FIG. 3. Furthermore, the timing chart of the velocity (initial velocity) of water flowing out of the pulsation generating device 74 in response thereto is illustrated in FIG. 5. Here, FIG. 5 is a waveform calculated from the formula of velocity $V=C\cdot\Delta P^{1/2}$ (C being a flow rate coefficient) based on the pressure value of FIG. 3.

As seen in FIG. 3, the pulse-like voltage applied to the pulsation generating coil 74*d* of the pulsation generating device 74 has a voltage waveform including one rectangular wave during one cycle. The velocity change of water flowing out of the pulsation generating device 74 caused by this control is illustrated with reference to the motion of the plunger 74*c* of the pulsation generating device 74. The pulsation generating coil 74*d* of the pulsation generating device 74 is applied with the voltage of the voltage waveform shown in FIG. 3.

When the pulsation generating coil 74*d* of the pulsation generating device 74 is applied with a voltage with on-time T1, a current flows. Hence, the pulsation generating coil 74*d* is excited, and the plunger 74*c* is magnetized. Then, if the plunger 74*c* is magnetized, the plunger 74*c* is attracted to the pulsation generating coil 74*d* side, i.e., to the downstream side.

By this attraction to the downstream side, the return spring 74*f* is compressed and accumulates elastic energy, and simultaneously pressurizes water to the highest pressure P4. At this time, the velocity of water jetted from the jetting port 401 is maximized (V4). That is, when the plunger 74*c* is attracted to the downstream side, the return spring 74*f* is compressed, and elastic energy is accumulated therein. Simultaneously, water is pressurized by the plunger 74*c*. Here, when the pressure of water reaches the highest pressure P4 (see FIG. 3), the velocity of water jetted from the jetting port 401 is maximized (V4 in FIG. 5).

Subsequently, when the voltage is turned off in T2, the excitation of the pulsation generating coil 74*d* is extinguished, and the original position is recovered under the biasing force of the return spring 74*f*. That is, when the application of voltage is stopped with off-time T2, the excitation of the pulsation generating coil 74*d* is canceled. Hence, the plunger 74*c* is returned to the original position by the biasing force of the return spring 74*f*.

Simultaneously, the pressure decreases to the lowest pressure P1 (see FIG. 3). At this time, the velocity of water jetted from the jetting port 401 also decreases to the lowest velocity region V1.

Subsequently, the pressure begins to return to the supply water pressure Pin, and the velocity also begins to return to the velocity Vin at the supply water pressure. At this time, by the biasing force of the return spring 74*f* and the inflow of water, the pressure of water reaches a second peak pressure P2 comparable to or above the supply water pressure. Hence, the velocity also exhibits a second peak velocity V2 comparable to or faster than the velocity at the supply water pressure. Furthermore, a certain period of time for jetting near the velocity Vin at the incoming water pressure occurs between the time of the second peak velocity V2 and the timing when the plunger 74*c* is excited again (the time when the velocity becomes V3).

Then, when the off-time T2 has elapsed, the pulsation generating coil 74*d* is excited again, and the plunger 74*c* is magnetized.

Here, the phenomenon of generating the jetting water group is illustrated.

The solid curve shown in FIG. 5 represents a velocity (initial velocity) waveform of water jetted from the jetting port of the washing nozzle 82. The dashed curve shown in FIG. 5 represents an overtaking curve. First, the overtaking curve is illustrated. The overtaking curve indicates that water portions, even with different jetted timings and jetted velocities, impinge simultaneously on the human private parts at 60 mm ahead as long as they are located on this curve. That is, the overtaking curve is a hypothetical curve for indicating the relationship between velocity and jetting timing for simultaneous impingement of water on the impinging position at a prescribed distance (which is set to 60 mm in this embodiment).

In this embodiment, as shown in FIG. 5, the waveform of the velocity (initial velocity) of water near the velocity V1 runs generally along the overtaking curve superimposed with the reference point set to the velocity V4 (i.e., the overtaking curve determined with reference to the velocity V4). Hence, as described later in detail, the water portion with slow velocity such as velocity V1 (slow ball) is overtaken by the pursuing water portion with fast velocity such as velocity V4 (fast ball) before impinging on the human private parts. Thus, the water portions unite and simultaneously impinge on the human private parts. Alternatively, the water portion with slow velocity such as velocity V1 (slow ball) is outstripped by the pursuing water portion with fast velocity such as velocity V4 (fast ball) before impinging on the human private parts. Thus, the water portion with fast velocity impinges on the human private parts earlier than the water portion with slow velocity.

Then, by the fast ball overtaking the slow ball, or by the fast ball outstripping the slow ball, the slow ball receives impact from the fast ball. This impact force enlarges the jetting water cross-sectional area of the slow ball. The water with an enlarged jetting water cross-sectional area has a larger impingement cross-sectional area (feeling of volume) when impinging on the human private parts. Thus, the slow ball with an enlarged jetting water cross-sectional area impinges on the human body. Hence, the impingement cross-sectional area is also large. Thus, the human feels as if a large amount of water impinges with a large cross-sectional area (the feeling of volume).

On the other hand, after overtaking the first water mass (slow ball), the second water mass (fast ball) impinges on the human body with relatively fast velocity even after overtaking the first water mass, because the first water mass and the second water mass are separately formed. Hence, the human feels as if being strongly washed with water having fast velocity (the feeling of stimulation). Thus, in this technique, the jetting water cross-sectional area of the slow ball is enlarged by the impact force by the fast ball overtaking the slow ball. By using this technique, a larger jetting water cross-sectional area can be formed than in the conventional technique for enlarging the jetting water cross-sectional area using overtaking by continuous velocity increase. This can realize washing with compatibility between the feeling of stimulation and the feeling of volume even with a smaller amount of water than conventional. With the same amount of water as conventional, washing with compatibility between the feeling of stimulation and the feeling of volume can be realized with a greater feeling of volume.

Furthermore, in the sanitary washing apparatus according to this embodiment, the up-gradient of pressure, or the pressure increment of water per unit time, in the region indicated by "F1" (between the pressures P1 and P2, or the first time span) in FIG. 3 is smaller than the up-gradient of pressure, or the pressure increment of water per unit time, in the region indicated by "F2" (between the pressures P3 and P4, or the second time span) in FIG. 3. In other words, the pressure increment of water per unit time in the region indicated by "F2" in FIG. 3 is larger than the pressure increment of water per unit time in the region indicated by "F1" in FIG. 3.

Put differently, the up-gradient of velocity (initial velocity), or the velocity (initial velocity) increment of water per unit time, in the region indicated by "G1" (between the velocities V1 and V2, or the first time span) in FIG. 5 is smaller than the up-gradient of velocity (initial velocity), or the velocity (initial velocity) increment of water per unit time, in the region indicated by "G2" (between the velocities V3 and V4, or the second time span) in FIG. 5. In other words, the velocity (initial velocity) increment of water per unit time in the region indicated by "G2" in FIG. 5 is larger than the velocity (initial velocity) increment of water per unit time in the region indicated by "G1" in FIG. 5.

Accordingly, in the region indicated by "F1" in FIG. 3, by increasing the pressure of water relatively slowly from the pressure P1 to the pressure P2, the velocity (initial velocity) of water jetted from the jetting port increases relatively slowly from the velocity V1 to the velocity V2. Thus, at a prescribed position, it is possible to further increase the amount of overtaking by which the subsequently jetted water (e.g., the water jetted with the velocity V2) overtakes the previously jetted water (e.g., the water jetted with the velocity V1). Hence, a large jetting water group for producing the feeling of volume can be generated in a larger size.

On the other hand, in the region indicated by "F2" in FIG. 3, by increasing the pressure of water relatively rapidly from the pressure P3 to the pressure P4, the velocity (initial velocity) of water jetted from the jetting port increases relatively rapidly from the velocity V3 to the velocity V4. Thus, although the amount of water is small, it is possible to generate a jetting water group with relatively fast velocity.

That is, in this embodiment, in the process (first jetting process) for generating a "jetting water group having a large jetting cross-sectional area and slow velocity (slow ball)" for producing the feeling of volume, the jetting cross-sectional area can be further increased by ensuring a sufficient amount of overtaking. Furthermore, in the process (second jetting process) for generating a "jetting water group having a small jetting cross-sectional area and fast velocity (fast ball)" for producing the feeling of stimulation, although the amount of water is small, it is possible to generate a jetting water group with relatively fast velocity. Hence, it is possible to realize highly comfortable washing with reliable compatibility between the feeling of volume and the feeling of stimulation while reducing the total amount of water used.

Furthermore, the pressure increment of water per unit time in the region indicated by "F11" (the first half between the pressures P1 and P2) in FIG. 3 is smaller than the pressure increment of water per unit time in the region indicated by "F12" (the second half between the pressures P1 and P2) in FIG. 3. In other words, the pressure increment of water per unit time in the region indicated by "F12" in FIG. 3 is larger than the pressure increment of water per unit time in the region indicated by "F11" in FIG. 3.

Put differently, the velocity (initial velocity) increment of water per unit time in the region indicated by "G11" (the first half between the velocities V1 and V2) in FIG. 5 is smaller than the velocity (initial velocity) increment of water per unit time in the region indicated by "G12" (the second half between the velocities V1 and V2) in FIG. 5. In other words, the velocity (initial velocity) increment of water per unit time in the region indicated by "G12" in FIG. 5 is larger than the velocity (initial velocity) increment of water per unit time in the region indicated by "G11" in FIG. 5.

Accordingly, with the increase of the initial velocity of water jetted from the jetting port, the rate of increase of the initial velocity is also increased. This can further increase the amount of overtaking by which the subsequently jetted water overtakes the previously jetted water. Hence, the large jetting water group for producing the feeling of volume can be made larger. This can realize washing with a greater feeling of volume.

Next, the state of water obtained from the velocity waveform produced as described above is illustrated.

FIG. 6A to FIG. 6D are schematic views for illustrating a process in which a pulsating flow of water jetted from a hypothetical jetting port 40 is amplified.

FIG. 7A to FIG. 7E are schematic views for illustrating another process in which a pulsating flow of water jetted from the hypothetical jetting port 40 is amplified.

Here, the relationship between pressure variation and velocity change is illustrated with reference to FIG. 3 and FIG. 5. When the pulsation generating device 74 causes the pressure to pulsate, the velocity V also varies and pulsates likewise. That is, in the jetted water, when the pressure variation reaches the maximum pressure Pmax, the velocity also reaches the maximum velocity Vmax. Thus, the instantaneous velocity varies with time. Each of the sites P1, P2, P3, P4, and P5 in the pressure waveform of the pulsating flow of water in FIG. 3 corresponds to the velocity V1, V2, V3, V4, and V5 in FIG. 5 with the same number.

Figure 6A:
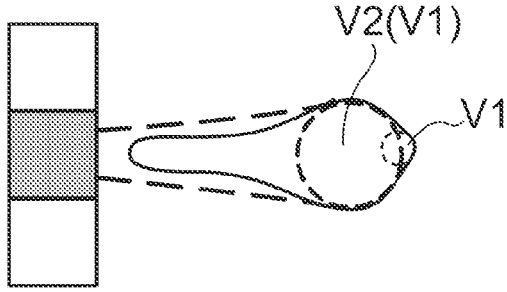
FIG. 6A to FIG. 6D are schematic views for illustrating a process in which a pulsating flow of water jetted from a hypothetical jetting port is amplified.

Hence, with the transition from immediately after jetting to FIGS. 6A to 6D, because the velocity V2 is faster than the velocity V1, the water jetted with the velocity V1 is overtaken by the water jetted with the velocity V2 and water existing therebetween to form a jetting water group having a large jetting cross-sectional area (see FIG. 6A).

Thus, in the up-gradient portion of the velocity waveform, the water jetted with fast velocity successively unites with the water previously jetted with slow velocity to form a large mass (jetting water group), which impinges on the human private parts (washing surface). Here, as shown in FIG. 6A, in the up-gradient portion of velocity in the slower velocity region, because the overall velocity is slow, V2 can unite with V1 to produce a jetting water group having a large jetting cross-sectional area before impinging on the human private parts.

That is, in the up-gradient portion of velocity between the velocities V1 and V2 (first jetting process), the overall velocity is slow. Hence, before the water jetted with the velocity V1 impinges on the human private parts, the water jetted with the velocity V2 can overtake the water jetted with the velocity V1. Consequently, before impinging on the human private parts, the water jetted with the velocity V2 can unite with the water jetted with the velocity V1 to produce a jetting water group (first water mass) having a large jetting cross-sectional area.

This water (jetting water group having a large jetting cross-sectional area) is in the state of having a large cross-sectional area of impingement (feeling of volume) when impinging on the human private parts.

Figure 6B:
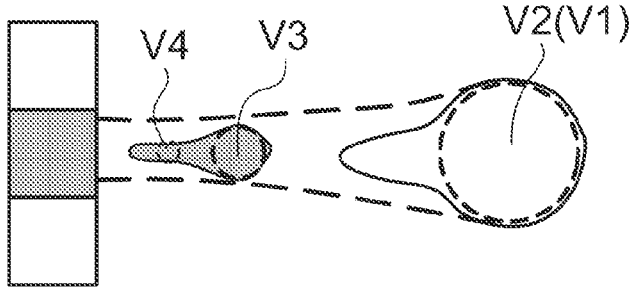

On the other hand, as shown in FIG. 6B, at velocities V3 and V4 on the velocity up-gradient in the faster velocity region, because the overall velocity is fast, the distance is less likely to decrease in the short time until impingement of water on the human private parts. Hence, at the time of impingement of water on the human private parts, V4 impinges as a fast jetting water group having a small jetting cross-sectional area without substantially uniting with V3.

That is, in the up-gradient portion of velocity between the velocities V3 and V4 (second jetting process), the overall velocity is fast. Hence, before the water jetted with the velocity V3 impinges on the human private parts, the water jetted with the velocity V4 is less likely to overtake the water jetted with the velocity V3. Consequently, before impinging on the human private parts, the water jetted with the velocity V3 and the water jetted with the velocity V4 scarcely unite with each other and can produce a jetting water group having a small jetting cross-sectional area (second water mass). This water (jetting water group having a small jetting cross-sectional area) is in the state of having a large velocity component in collision energy (feeling of stimulation) when impinging on the human private parts.

Furthermore, at this time, by controlling so as to provide a prescribed interval between the timings of V2 and V4, in other words, to produce peaks at V2 and V4, a prescribed time interval occurs, when V4 is jetted, between the jetting water group generated by V2 and the jetting water group generated by V4.

That is, a prescribed waiting time is provided between the up-gradient portion of velocity between the velocities V1 and V2 (first jetting process) and the up-gradient portion of velocity between the velocities V3 and V4 (second jetting process). Thus, a prescribed time interval can be provided between the water jetted with the velocity V2 and the water jetted with the velocity V4.

Consequently, at a prescribed position from the jetting port, the first water mass with slow velocity (slow ball) and the second water mass with fast velocity (fast ball) can be separately formed.

Figure 6C:
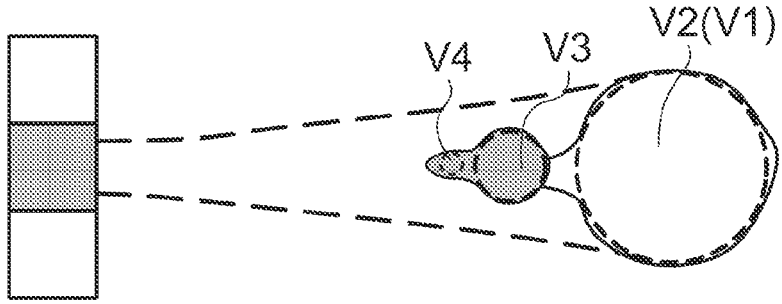
Figure 6D:
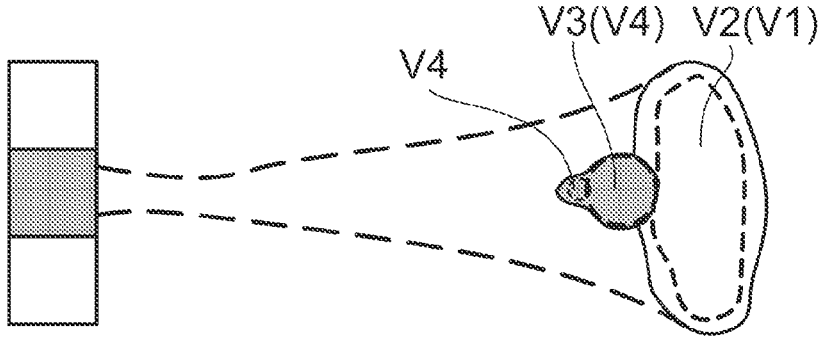

Furthermore, as described above with reference to FIG. 5, in this embodiment, the waveform of the velocity (initial velocity) of water near the velocity V1 runs generally along the overtaking curve superimposed with the reference point set to the velocity V4 (i.e., the overtaking curve determined with reference to the velocity V4). Hence, as shown in FIGS. 6C and 6D, the water portion with slow velocity such as velocity V1 (slow ball) is overtaken by the pursuing water portion with fast velocity such as velocity V4 (fast ball) before impinging on the human private parts. Thus, the water portions unite and simultaneously impinge on the human private parts. That is, in this embodiment, water masses are not only formed during the first jetting process and during the second jetting process, but also the first water mass (slow ball) formed in the first jetting process is overtaken by the second water mass (fast ball) formed in the second jetting process different from the first jetting process before impinging on the human private parts.

Then, by the fast ball overtaking the slow ball, the slow ball receives impact from the fast ball. This impact force enlarges the jetting water cross-sectional area of the slow ball as shown in FIG. 6D. The water with an enlarged jetting water cross-sectional area has a larger impingement cross-sectional area (feeling of volume) when impinging on the human private parts. That is, in the water with a large jetting water cross-sectional area, the amount of water is large. Hence, the same feeling as in being washed with a large amount of water can be obtained. Thus, in this embodiment, the jetting water cross-sectional area for producing the feeling of volume can be enlarged. Hence, it is possible to provide the feeling of volume by the slow ball having an enlarged cross-sectional area while producing the feeling of stimulation by the fast ball. That is, washing with compatibility between the feeling of stimulation and the feeling of volume can be realized.

Figure 7A:
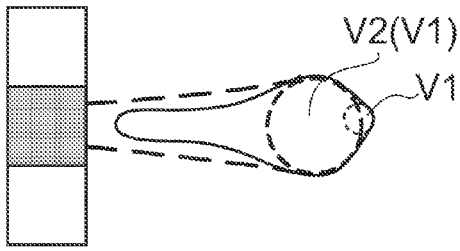
FIG. 7A to FIG. 7E are schematic views for illustrating another process in which a pulsating flow of water jetted from the hypothetical jetting port is amplified.
Figure 7B:
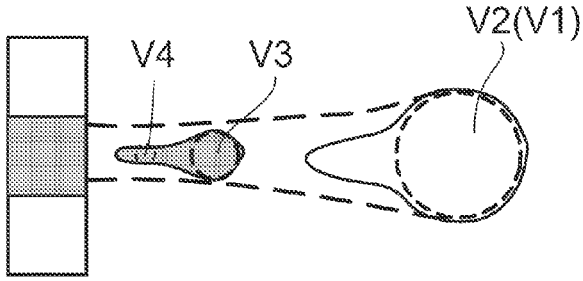
Figure 7C:
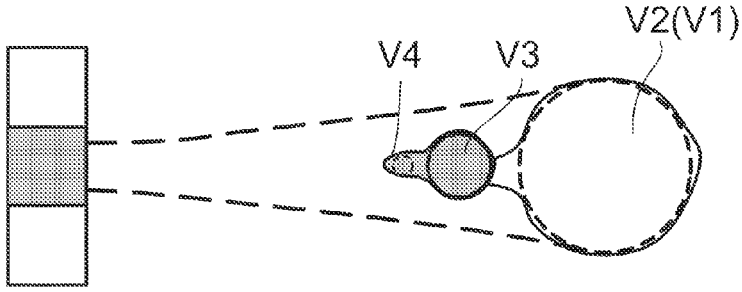
Figure 7D:
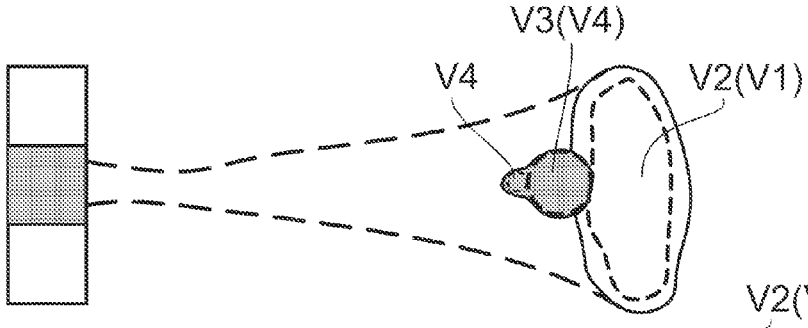
Figure 7E:
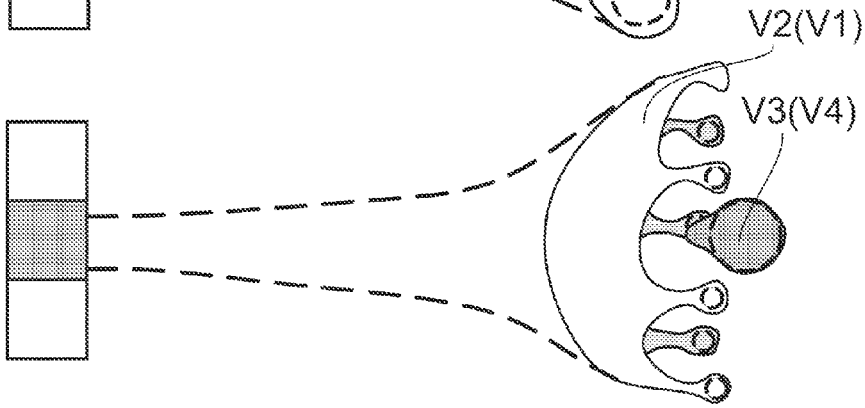

Alternatively, in this embodiment, the prescribed waiting time can be suitably set. Thus, as shown in FIG. 7E, the water portion with slow velocity such as velocity V1 (slow ball) is outstripped by the pursuing water portion with fast velocity such as velocity V4 (fast ball) before impinging on the human private parts. Thus, the water portion with fast velocity impinges on the human private parts earlier than the water portion with slow velocity. That is, in this embodiment, water masses are not only formed during the first jetting process and during the second jetting process, but also the first water mass (slow ball) formed in the first jetting process is outstripped by the second water mass (fast ball) formed in the second jetting process different from the first jetting process before impinging on the human private parts. Here, the state of water shown in FIGS. 7A to 7D are similar to the state of water shown in FIGS. 6A to 6D.

Then, by the fast ball outstripping the slow ball, the slow ball receives impact from the fast ball. By the impact force, the jetting water cross-sectional area of the slow ball is made even larger than in the case where the fast ball overtakes the slow ball. This can realize washing with a greater feeling of volume. Furthermore, the fast ball impinges on the human private parts earlier than the slow ball without being absorbed by the slow ball. Hence, the fast ball impinges on the human private parts without attenuation of the feeling of stimulation of the fast ball. Thus, in the jetting water group with an enlarged jetting water cross-sectional area, the amount of water is large. Hence, the same feeling as in being washed with a large amount of water can be obtained. Furthermore, the jetting water group with a small jetting cross-sectional area and fast velocity impinges on the human private parts without deceleration. Hence, the feeling of stimulation can be produced. Moreover, by causing this jetting water group (the jetting water group with a small jetting cross-sectional area and fast velocity) to impinge on the human private parts with high frequency, the feeling of stimulation and the feeling of volume can be produced simultaneously.

Furthermore, as described above, in the first jetting process, the water jetted with the velocity V2 can unite with the water jetted with the velocity V1 to produce a first water mass having a large jetting cross-sectional area (slow ball). Thus, by previously forming a slow ball as a water mass with a large diameter, the jetting water cross-sectional area after the collision of the fast ball with the slow ball can be formed in a larger size. This can realize washing with a greater feeling of volume.

At the timing of transition from the velocity V4 to the velocity V1, the velocity is decelerated. Thus, no jetting water group is generated by union, and this region does not contribute to the feeling of washing. Hence, reduction of this region leads also to enhancing the feeling of washing.

The inventors have considered that the feeling of washing is represented by the feeling of stimulation and the feeling of volume, which depend on the impact force M·V of jetting water. The feeling of stimulation is a feeling in which stimulation similar to pain is felt by impingement of fast jetting water on the human private parts, and depends on the velocity V. On the other hand, the feeling of volume is a feeling in which impingement of a thick water flow is felt by impingement of jetting water having a large jetting cross-sectional area S (weight M) with sufficient strength. The larger the impinging area of jetting water, the more the feeling of volume is produced. Comfortable washing can be realized by satisfying all these physical quantities.

The jetting water group is one in which the cross-sectional area cut perpendicular to the traveling direction of water jetted from the jetting port is larger than the cross-sectional area immediately after jetting from the jetting port due to overtaking after jetting. That is, the jetting water group refers to one in which the jetting cross-sectional area (the cross-sectional area cut perpendicular to the traveling direction of water) is larger than the jetting cross-sectional area immediately after jetting due to overtaking of the subsequently jetted water.

Here, if the jetting cross-sectional area increases and results in a jetting water group with a different jetting cross-sectional area due to overtaking of water after jetting, the load when impinging on the human private parts is larger than that of jetting without increase in jetting cross-sectional area (without formation of the jetting water group).

Next, an alternative embodiment of the invention is described with reference to the drawings.

Figure 8:
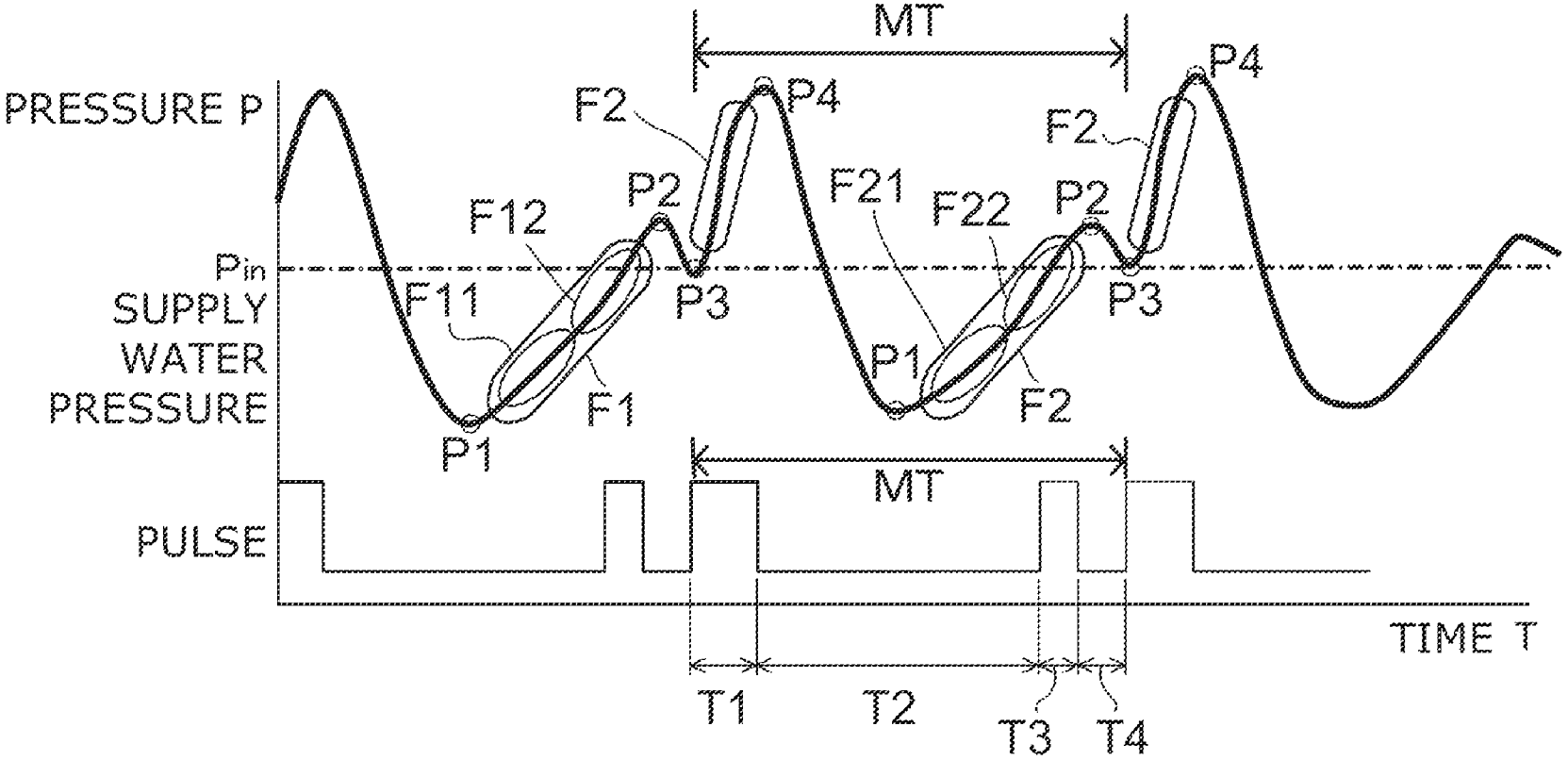
FIG. 8 is a schematic view for illustrating the pressure variation of water and the excitation of a pulsation generating coil of a pulsation generating device for generating pulsation in jetting water in a sanitary washing apparatus according to an alternative embodiment of the invention.

FIG. 8 is a schematic view for illustrating the pressure variation of water and the excitation of the pulsation generating coil 74*d* of the pulsation generating device 74 for generating pulsation in jetting water in a sanitary washing apparatus according to the alternative embodiment of the invention.

Figure 9:
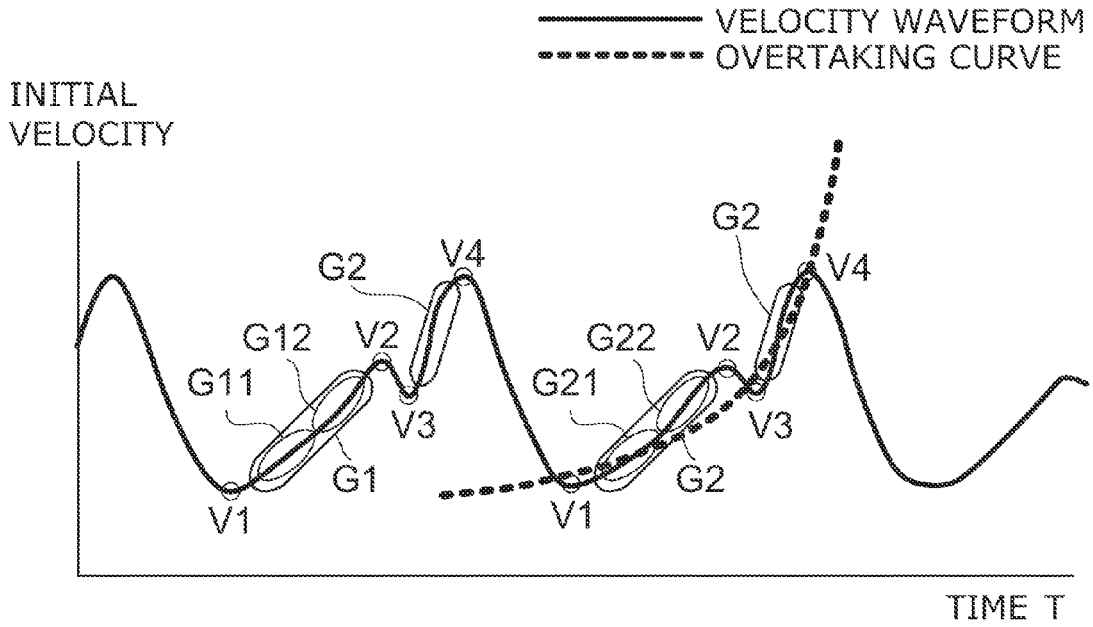
FIG. 9 is a timing chart showing the velocity (initial velocity) of water flowing out of the pulsation generating device in the sanitary washing apparatus according to the embodiment.

FIG. 9 is a timing chart showing the velocity (initial velocity) of water flowing out of the pulsation generating device in the sanitary washing apparatus according to this embodiment.

Here, the upper row of FIG. 8 is a schematic view for illustrating the pressure variation of water. The lower row of FIG. 8 is a voltage waveform showing the excitation of the pulsation generating coil 74*d* of the pulsation generating device for generating pulsation in jetting water (a schematic diagram for illustrating the voltage waveform applied to the pulsation generating coil 74*d*).

In this embodiment, the pulse-like voltage applied to the pulsation generating coil 74*d* of the pulsation generating device 74 has a voltage waveform in which two rectangular waves with different on-times are combined during one cycle. The velocity change of water flowing out of the pulsation generating device 74 caused by this control is illustrated with reference to the motion of the plunger 74*c* of the pulsation generating device 74. The pulsation generating coil 74*d* of the pulsation generating device 74 is applied with the voltage of the voltage waveform shown in FIG. 8.

When the pulsation generating coil 74*d* of the pulsation generating device 74 is applied with a voltage with on-time T1, a current flows. Hence, the pulsation generating coil 74*d* is excited, and the plunger 74*c* is magnetized. Then, if the plunger 74*c* is magnetized, the plunger 74*c* is attracted to the pulsation generating coil 74*d* side, i.e., to the downstream side.

By this attraction to the downstream side, the return spring 74*f* is compressed and accumulates elastic energy, and simultaneously pressurizes water to the highest pressure P4. At this time, the velocity of water jetted from the jetting port 401 is maximized (V4). That is, when the plunger 74*c* is attracted to the downstream side, the return spring 74*f* is compressed, and elastic energy is accumulated therein. Simultaneously, water is pressurized by the plunger 74*c*. Here, when the pressure of water reaches the highest pressure P4 (see FIG. 8), the velocity of water jetted from the jetting port 401 is maximized (V4 in FIG. 9).

Subsequently, when the voltage is turned off in T2, the excitation of the pulsation generating coil 74*d* is extinguished, and the original position is recovered under the biasing force of the return spring 74*f*. That is, when the application of voltage is stopped with off-time T2, the excitation of the pulsation generating coil 74*d* is canceled. Hence, the plunger 74*c* is returned to the original position by the biasing force of the return spring 74*f*.

Simultaneously, the pressure decreases to the lowest pressure P1 (see FIG. 8). At this time, the velocity of water jetted from the jetting port 401 also decreases to the lowest velocity region V1.

Subsequently, the pressure begins to return to the supply water pressure Pin, and the velocity also begins to return to the velocity Vin at the supply water pressure. At this timing of return, a rectangular wave with on-time T3 shorter than T1 is applied to excite the pulsation generating coil 74*d* and attract the plunger 74*c* to the downstream side, thereby pressurizing the water again. That is, at this timing of return, a rectangular-wave voltage with on-time T3 shorter than T1 is applied to the pulsation generating coil 74*d*. Thus, the water is pressurized again by exciting the pulsation generating coil 74*d* and attracting the plunger 74*c* to the downstream side.

Here, because the pressure is on the way of return and T3 is shorter in time than T1, the water does not rise to the highest pressure P4, but reaches a second peak pressure P2 higher than the supply water pressure. Hence, the velocity also exhibits a second peak velocity V2 faster than the velocity at the supply water pressure. Furthermore, a certain period of time for jetting near the velocity Vin at the incoming water pressure occurs between the second peak velocity V2 and a velocity V3 at the timing when the plunger is excited again.

Here, the phenomenon of generating the jetting water group is illustrated.

The solid curve shown in FIG. 9 represents a velocity (initial velocity) waveform of water jetted from the jetting port of the washing nozzle 82. The dashed curve shown in FIG. 9 represents an overtaking curve. The overtaking curve is defined as described above with reference to FIG. 5.

In this embodiment, as shown in FIG. 9, the waveform of the velocity (initial velocity) of water near the velocity V1 runs generally along the overtaking curve superimposed with the reference point set to the velocity V4 (i.e., the overtaking curve determined with reference to the velocity V4). Here, in this embodiment, at the timing when the pressure begins to return to the supply water pressure Pin, a rectangular wave with on-time T3 shorter than T1 is applied. Thus, the waveform of the velocity (initial velocity) of water near the velocity V1 runs more easily along the overtaking curve superimposed with the reference point set to the velocity V4 than in the case where the rectangular wave with on-time T3 is not applied.

Hence, in the process (first jetting process) for generating a "jetting water group having a large jetting cross-sectional area and slow velocity" for producing the feeling of volume, water portions with different jetted timings and jetted velocities can be caused to simultaneously impinge on the impinging position at a prescribed distance. That is, in the first jetting process, the water jetted with the velocity V2 can unite with the water jetted with the velocity V1 to produce a first water mass having a large jetting cross-sectional area (slow ball). Thus, by previously forming a slow ball as a water mass with a larger diameter, the jetting water cross-sectional area after the collision of the fast ball with the slow ball can be formed in a larger size. This can realize washing with a greater feeling of volume.

Furthermore, in this embodiment, the waveform of the velocity (initial velocity) of water near the velocity V1 easily runs along the overtaking curve superimposed with the reference point set to the velocity V4. Hence, the pursuing water with fast velocity such as velocity V4 (fast ball) can reliably overtake or outstrip the water with slow velocity such as velocity V1 (slow ball) (see FIG. 6A to FIG. 6D and FIG. 7A to FIG. 7E). Accordingly, a similar effect to that described above with reference to FIG. 3 to FIG. 7E can be achieved. Thus, washing with compatibility between the feeling of stimulation and the feeling of volume can be realized.

Furthermore, in this embodiment, as described above with reference to FIG. 3, the up-gradient of pressure, or the pressure increment of water per unit time, in the region indicated by "F1" (between the pressures P1 and P2) in FIG. 8 is smaller than the up-gradient of pressure, or the pressure increment of water per unit time, in the region indicated by "F2" (between the pressures P3 and P4) in FIG. 8. In other words, the pressure increment of water per unit time in the region indicated by "F2" in FIG. 8 is larger than the pressure increment of water per unit time in the region indicated by "F1" in FIG. 8.

Put differently, as described above with reference to FIG. 5, the up-gradient of velocity (initial velocity), or the velocity (initial velocity) increment of water per unit time, in the region indicated by "G1" (between the velocities V1 and V2) in FIG. 9 is smaller than the up-gradient of velocity (initial velocity), or the velocity (initial velocity) increment of water per unit time, in the region indicated by "G2" (between the velocities V3 and V4) in FIG. 9. In other words, the velocity (initial velocity) increment of water per unit time in the region indicated by "G2" in FIG. 9 is larger than the velocity (initial velocity) increment of water per unit time in the region indicated by "G1" in FIG. 9.

Accordingly, as described above with reference to FIG. 3 and FIG. 5, in the process (first jetting process) for generating a "jetting water group having a large jetting cross-sectional area and slow velocity (slow ball)" for producing the feeling of volume, the jetting cross-sectional area can be further increased by ensuring a sufficient amount of overtaking. Furthermore, in the process (second jetting process) for generating a "jetting water group having a small jetting cross-sectional area and fast velocity (fast ball)" for producing the feeling of stimulation, although the amount of water is small, it is possible to generate a jetting water group with relatively fast velocity. Hence, it is possible to realize highly comfortable washing with reliable compatibility between the feeling of volume and the feeling of stimulation while reducing the total amount of water used.

Furthermore, as described above with reference to FIG. 3, the pressure increment of water per unit time in the region indicated by "F11" (the first half between the pressures P1 and P2) in FIG. 8 is smaller than the pressure increment of water per unit time in the region indicated by "F12" (the second half between the pressures P1 and P2) in FIG. 8. In other words, the pressure increment of water per unit time in the region indicated by "F12" in FIG. 8 is larger than the pressure increment of water per unit time in the region indicated by "F11" in FIG. 8.

Put differently, as described above with reference to FIG. 5, the velocity (initial velocity) increment of water per unit time in the region indicated by "G11" (the first half between the velocities V1 and V2) in FIG. 9 is smaller than the velocity (initial velocity) increment of water per unit time in the region indicated by "G12" (the second half between the velocities V1 and V2) in FIG. 9. In other words, the velocity (initial velocity) increment of water per unit time in the region indicated by "G12" in FIG. 9 is larger than the velocity (initial velocity) increment of water per unit time in the region indicated by "G11" in FIG. 9.

Accordingly, as described above with reference to FIG. 3 and FIG. 5, with the increase of the initial velocity of water jetted from the jetting port, the rate of increase of the initial velocity is also increased. This can further increase the amount of overtaking by which the subsequently jetted water overtakes the previously jetted water. Hence, the large jetting water group for producing the feeling of volume can be made larger. This can realize washing with a greater feeling of volume.

Next, a further alternative embodiment of the invention is described with reference to the drawings.

Figure 10:
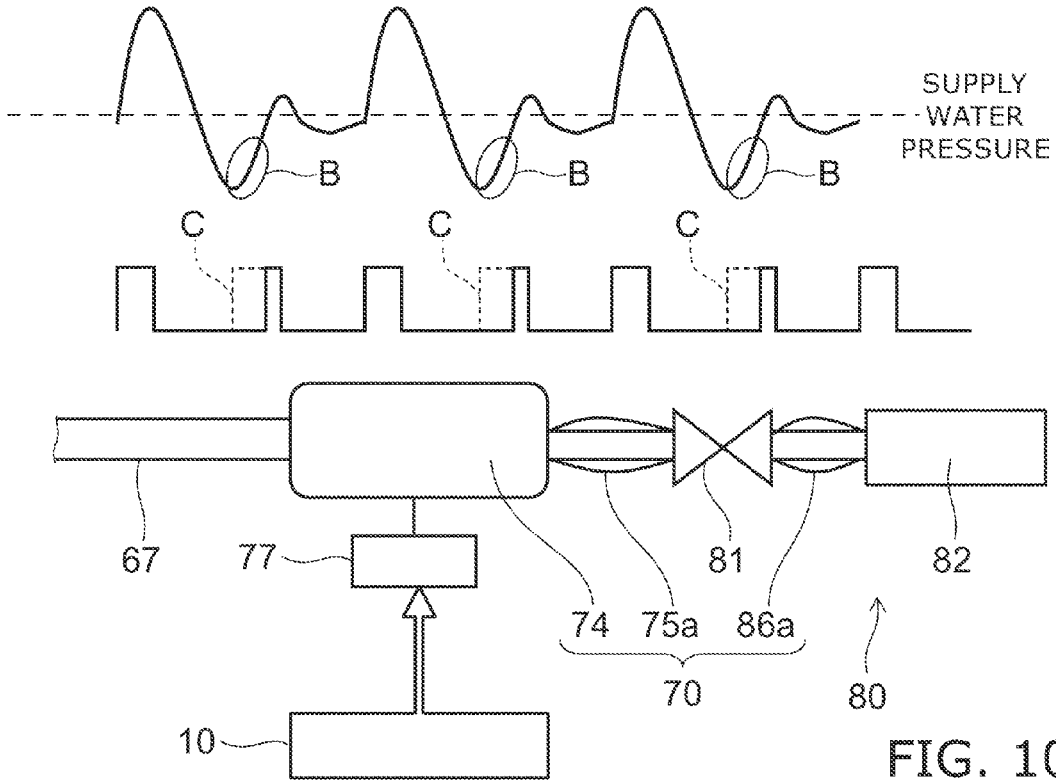
FIG. 10 is a schematic view for illustrating the case where a pressure accumulating section is provided in a sanitary washing apparatus according to a further alternative embodiment of the invention.

FIG. 10 is a schematic view for illustrating the case where a pressure accumulating section is provided. Components similar to those described above are labeled with like reference numerals, and the description thereof is omitted.

As shown in FIG. 10, the pulsation generating device 74 and the flow rate regulating/flow channel switching valve 81 are connected by a pressure accumulating section (pressure accumulator) 75*a*. The flow rate regulating/flow channel switching valve 81 and the washing nozzle 82 are connected by a pressure accumulating section (pressure accumulator) 86*a*.

The pressure accumulating sections 75*a* and 86*a* can be ones elastically deformed under water pressure. For instance, they can be tubes or the like formed from resin, rubber or the like.

The elastic energy accumulated in the pressure accumulating sections 75*a* and 86*a* under water pressure can be used to help pressurize water. In particular, in the low pressure region, pressurization of water can be effectively performed. For instance, in the region indicated by "B" in FIG. 10, pressurization of water can be effectively performed.

In this case, by using the pressurizing action of the pressure accumulating sections 75*a* and 86*a*, the time of voltage application in the region indicated by "B" can be reduced as indicated by "C". Thus, it is possible to reduce power consumption, and to reduce the amount of heat generation of the pulsation generating device 74.

Although FIG. 10 illustrates the case where the pressure accumulating section 75*a* and the pressure accumulating section 86*a* are provided, it is possible to provide at least one of them.

Furthermore, the elastic energy accumulated in the pressure accumulating sections 75*a* and 86*a* can be varied by suitably selecting the spring constant and the like of the material.

Next, a further alternative embodiment of the invention is described with reference to the drawings.

Figure 11:
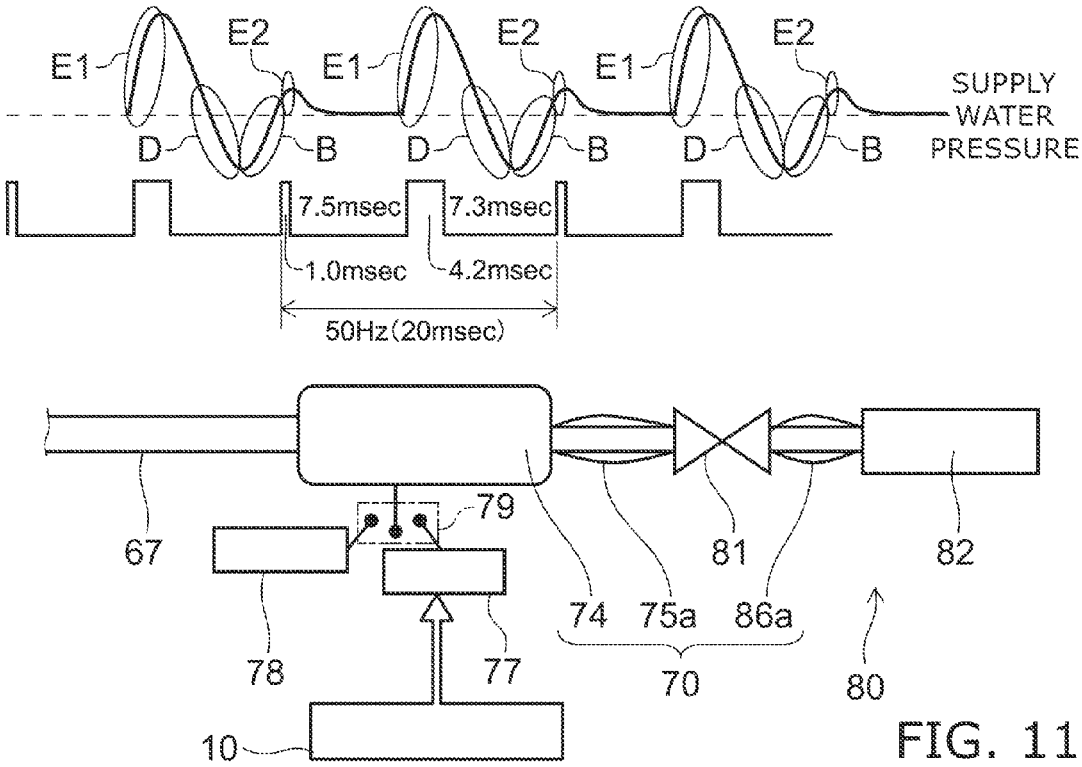
FIG. 11 is a schematic view for illustrating the case where a residual charge consuming circuit and a pressure accumulating section are provided in a sanitary washing apparatus according to a further alternative embodiment of the invention.

FIG. 11 is a schematic view for illustrating the case where a residual charge consuming circuit and a pressure accumulating section are provided. Components similar to those described above are labeled with like reference numerals, and the description thereof is omitted.

In this embodiment, at the timing corresponding to the region indicated by "D" in FIG. 11, the remanent magnetism can be reduced by the action of the residual charge consuming circuit 78. Furthermore, in the region indicated by "B", pressurization of water can be effectively performed by the action of the pressure accumulating sections 75*a* and 86*a*. Furthermore, in the regions indicated by "E1" and "E2", pressurization of water can be actively performed by the action of the pulsation generating device 74.

As a variation, an air mixing section, not shown, may be provided so that air can be mixed from the tip portion (water vortex chambers 301 and 302 in FIG. 4A and FIG. 4B) of the washing nozzle 82. The air mixing section can be such that air pressurized by an air pump for forcibly introducing air is mixed from a tube connected to the tip of the washing nozzle 82. In this case, by controlling the air pump in synchronization with the pressure variation (see FIG. 5) caused by the pulsation generating device, the timing when the pressurized air is mixed can be adjusted.

For instance, the air pump can be controlled in synchronization with the voltage waveform applied to the pulsation generating device so that air is mixed in the up-gradient range of the slow velocity region. Thus, when air is mixed at the timing when a large jetting water group is generated, the jetting water group is scattered into a wide range. That is, the apparent jetting cross-sectional area is increased by air and results in a greater feeling of volume.

On the other hand, in the fast velocity region, by preventing air from mixing, the water with fast velocity is jetted without scattering, and impinges on the human private parts while maintaining the velocity. This also enables compatibility between the feeling of stimulation and the feeling of volume in the state of a greater feeling of volume. Here, because the air mixing section is provided at the tip of the washing nozzle 82, air can be efficiently mixed. Furthermore, because air is not mixed more than necessity in the fast velocity region, it is also possible to prevent the feeling of stimulation from attenuating due to the damper effect of air.

The disposing position of the air mixing section is not limited to the tip of the washing nozzle 82, but it may be provided so that air can be mixed into the piping on the upstream side of the washing nozzle 82. Furthermore, the air mixing section is not necessarily one capable of forcible mixing, but may be based on natural aspiration. In the case of using natural aspiration, air is mixed into water as bubbles. If air is mixed into water as bubbles, the volume of the jetting water group can be increased. Consequently, this enables compatibility between the feeling of stimulation and the feeling of volume in the state of a greater feeling of volume.

As illustrated above, a "jetting water group having a large jetting cross-sectional area and slow velocity" and a "jetting water group having a small jetting cross-sectional area and fast velocity" are generated by varying the amount of overtaking by which the subsequently jetted water overtakes the previously jetted water.

That is, the controller 10 is configured to perform a first control in a first jetting process (the control for generating a "jetting water group having a large jetting cross-sectional area and slow velocity") and a second control in a second jetting process (the control for generating a "jetting water group having a small jetting cross-sectional area and fast velocity"). The jetting of water by the first jetting process and the jetting of water by the second jetting process are performed from the same jetting port. In the first jetting process, the initial velocity at jetting time is made lower than in the second jetting process so that at a prescribed position from the jetting port, the amount of overtaking by which the previously jetted water is overtaken by the subsequently jetted water is larger than in the second jetting process. In the second jetting process, the initial velocity at jetting time is made higher than in the first jetting process so that at the prescribed position from the jetting port, the amount of overtaking by which the previously jetted water is overtaken by the subsequently jetted water is smaller than in the first jetting process. The first jetting process and the second jetting process are alternately performed so that the jetting of water by the first jetting process and the jetting of water by the second jetting process are alternately jetted from the same jetting port.

Furthermore, the prescribed waiting time between the first jetting process and the second jetting process is set so that the water previously jetted by the first jetting process (slow ball) is overtaken by the water subsequently jetted by the second jetting process (fast ball) before impinging on the human private parts. Alternatively, the prescribed waiting time between the first jetting process and the second jetting process is set so that the water previously jetted by the first jetting process (slow ball) is outstripped by the water subsequently jetted by the second jetting process (fast ball) before impinging on the human private parts.

Hence, by the fast ball overtaking the slow ball, or by the fast ball outstripping the slow ball, the slow ball receives impact from the fast ball. This impact force enlarges the jetting water cross-sectional area of the slow ball. The water with an enlarged jetting water cross-sectional area has a larger impingement cross-sectional area (feeling of volume) when impinging on the human private parts. That is, in the water with a large jetting water cross-sectional area, the amount of water is large. Hence, the same feeling as in being washed with a large amount of water can be obtained. Thus, in this embodiment, the jetting water cross-sectional area for producing the feeling of volume can be enlarged. Hence, it is possible to provide the feeling of volume by the slow ball having an enlarged cross-sectional area while producing the feeling of stimulation by the fast ball. That is, washing with compatibility between the feeling of stimulation and the feeling of volume can be realized.

Furthermore, the feeling of volume can be produced by the "jetting water group having a large jetting cross-sectional area and slow velocity". Furthermore, the feeling of stimulation can be produced by the "jetting water group having a small jetting cross-sectional area and fast velocity".

Consequently, even with a limited amount of water, it is possible to realize a highly comfortable sanitary washing apparatus capable of producing the feeling of volume and the feeling of stimulation just like being washed with a large amount of water.

Here, the feeling of water being jetted with the feeling of stimulation and the feeling of volume can be produced by causing each of the aforementioned "different jetting water groups" to impinge on the human private parts at least once in the dead band frequency region of approximately 5 Hz or more, which a human being cannot perceive as intentional repetition of jetting.

Furthermore, in the first jetting process, a region of pressure lower than the supply water pressure is formed so that water is jetted in the region of pressure lower than the supply water pressure to decrease the initial velocity at jetting time, thereby increasing the amount of overtaking. In the second jetting process, water is jetted in the region of pressure higher than the supply water pressure so that the initial velocity at jetting time is made higher than in the first jetting process.

Furthermore, the pressurizer includes a single pressurizing section. The controller 10 is configured to perform a first pressurization by the pressurizer in the first jetting process, and a second pressurization by the pressurizer in the second jetting process. Then, a "jetting water group having a large jetting cross-sectional area and slow velocity" and a "jetting water group having a small jetting cross-sectional area and fast velocity" can be generated by the pulsation generating device 74 including one pressurizing section. Thus, the structure of the pulsation generating device 74 can be further simplified. Furthermore, the initial velocity at jetting time can be set to an appropriate value by a simple control configuration of using one pulsation generating device 74 to perform the first pressurization in a region of pressure at least lower than the supply water pressure and perform the second pressurization in a region of pressure at least higher than the supply water pressure in the first jetting process. That is, a sharp velocity difference can be provided to the initial velocity at jetting time between in the jetting by the first pressurization and in the jetting by the second pressurization.

Furthermore, when in the region of pressure lower than the supply water pressure, generation of a "jetting water group having a large jetting cross-sectional area and slow velocity" is started. Hence, because the velocity can be slowed down, it is possible to increase the amount of subsequently jetted water overtaking the previously jetted water. Consequently, this facilitates generating a "jetting water group having a large jetting cross-sectional area and slow velocity".

Furthermore, by further using the region higher than the supply water pressure formed by rebound at the time of return from the bottom velocity V1 (at the time when the pressure returns to the supply water pressure), the jetting time for generating the "jetting water group having a large jetting cross-sectional area and slow velocity" can be prolonged. Hence, the size of the "jetting water group having a large jetting cross-sectional area and slow velocity" can be further increased.

On the other hand, a high pressure region is formed by active pressurization from the neighborhood of the supply water pressure so that a "jetting water group having a small jetting cross-sectional area and fast velocity" is generated in the high pressure region. Hence, because the velocity can be accelerated, it is possible to suppress that the subsequently jetted water overtakes the previously jetted water. Consequently, this facilitates generating a "jetting water group having a small jetting cross-sectional area and fast velocity".

Furthermore, by further increasing the pressure P4 by active pressurization from the neighborhood of the supply water pressure, the pressure P1 formed subsequently is further decreased. This can facilitate forming the aforementioned "region of pressure lower than the supply water pressure".

Furthermore, active pressurization is performed at the time of return of pressure to the supply water pressure. This makes it possible to rapidly and stably obtain the pressure near the supply water pressure.

A pressure accumulating section is further provided between the pulsation generating device 74 and the washing nozzle 82 to accumulate the pressure from water. The pressure accumulating section accumulates the pressure from water in the second jetting process and applies the accumulated pressure to water in the first jetting process. In this case, in the second jetting process, a second pressurization is performed to jet water in a region of pressure at least higher than the supply water pressure, and the pressure from water is accumulated in the pressure accumulating section by this second pressurization. Thus, the pressure accumulated in the pressure accumulating section can be applied to water in the state in which the pressure of water is lower than the supply water pressure.

Then, part of the high pressure at the time of generating a "jetting water group having a small jetting cross-sectional area and fast velocity" is accumulated in the second jetting process so that the accumulated pressure can be used in generating a "jetting water group having a large jetting cross-sectional area and slow velocity". Consequently, the "jetting water group having a large jetting cross-sectional area and slow velocity" can be generated reliably and efficiently.

The pressure accumulating section can be configured to provide water with the pressure accumulated when the water pressure is lower than the supply water pressure. Such a pressure accumulating section can be formed by suitably selecting the spring constant and the like of the material. By providing such a pressure accumulating section, the pressure accumulated at a lower water pressure can be applied to water. Hence, jetting can be started at a lower pressure, i.e., at a slower velocity. Thus, because the amount of overtaking can be increased, a larger "jetting water group having a large jetting cross-sectional area and slow velocity" can be generated.

Furthermore, the pressure accumulating section can be formed as an elastically deformable hose used for a supply water conduit connecting between the pulsation generating device 74 and the washing nozzle 82. Then, the pressure accumulating section can be formed from a simple configuration of an elastically deformable hose.

Furthermore, in the first jetting process, a first pressurization for jetting water in a region of pressure at least lower than the supply water pressure is performed. Thus, the first pressurization can be performed in combination with application of pressure by the pressure accumulating section. Then, the "jetting water group having a large jetting cross-sectional area and slow velocity" can be generated by both the pressurization by the pressure accumulating section and the first pressurization. Hence, a "jetting water group having a large jetting cross-sectional area and slow velocity" with a prescribed size can be generated more reliably.

Furthermore, the first pressurization can be performed in the second half of the process for jetting water in the first jetting process. By performing the first pressurization in the second half of the process, its timing can be shifted from the pressurization by the pressure accumulating section. That is, the pressurization by the pressure accumulating section and the first pressurization can be performed not in parallel but in series. Thus, it is possible to suppress the increase of the velocity of water, and to perform jetting with a slow velocity for a long period of time. Consequently, a "jetting water group having a large jetting cross-sectional area and slow velocity" with a prescribed size can be generated more reliably.

Furthermore, the time for which the first pressurization is performed by the pressurizer can be controlled to be shorter than the time for which the second pressurization is performed by the pressurizer. Then, the time of pressurization by the pressurizer in the first jetting process can be reduced. Hence, the apparatus lifetime can be extended by the reduction of control time.

Furthermore, the waiting time can be terminated when the inner pressure of the washing nozzle 82 becomes the supply water pressure.

Then, the second jetting process performed after the waiting time can be started in the state of stabilized pressure. Thus, the pressurization energy in the second jetting process can be efficiently used to accelerate water. Hence, the velocity of the "jetting water group having a small jetting cross-sectional area and fast velocity" can be reliably increased.

Furthermore, the waiting time can be set so as to equalize the interval between the impingement of the first water mass formed by the first jetting process and the impingement of the second water mass formed by the second jetting process.

This can equalize the time interval between when the "jetting water group having a large jetting cross-sectional area and slow velocity" and the "jetting water group having a small jetting cross-sectional area and fast velocity" impinge on the human private parts. Hence, more continuous feeling can be produced.

Furthermore, "different jetting water groups" are generated by using one pulsation generating device 74 and controlling its operation timing. Furthermore, the condition for generating the "different jetting water groups" is controlled so as to be appropriate. This can lead to downsizing, simplification, cost reduction and the like of the sanitary washing apparatus 1.

The embodiments of the invention have been described above. However, the invention is not limited to the above description. Those skilled in the art can suitably modify the above embodiments, and such modifications are also encompassed within the scope of the invention as long as they include the features of the invention. For instance, the shape, dimension, material, and layout of various components in the pulsation generating device 74 and the like, and the installation configuration of the pressure accumulating section 75*a*, 86*a* are not limited to those illustrated, but can be suitably modified.

Furthermore, various components in the above embodiments can be combined with each other as long as technically feasible. Such combinations are also encompassed within the scope of the invention as long as they include the features of the invention.

The invention claimed is:

1. A sanitary washing apparatus configured to jet supplied water toward a human body, comprising:

a washing nozzle including a jetting port configured to jet the water toward the human body; and a pressurizing device configured to pressurize the water and jet it from the jetting port, the sanitary washing apparatus being configured to perform a first jetting process having a first time span and a second jetting process having a second time span, jetting water by the first jetting process and jetting water by the second jetting process being alternately jetted from the jetting port, after performing the first jetting process, a prescribed waiting time being provided before performing the second jetting process, in the first jetting process, the pressurizing device making pressure of water subsequently jetted during the first time span higher than pressure of water previously jetted in the first jetting process so that the water subsequently jetted during the first time span overtakes and unites with the water previously jetted in the first jetting process at a prescribed position from the jetting port to form a first water mass, in the second jetting process, the pressurizing device making pressure of water subsequently jetted during the second time span higher than pressure of water previously jetted in the second jetting process so that the water subsequently jetted during the second time span overtakes and unites with the water previously jetted in the second jetting process at a prescribed position from the jetting port to form a second water mass, the pressurizing device making minimum pressure of water in the second jetting process higher than minimum pressure of water in the first jetting process and making maximum pressure of water in the second jetting process higher than maximum pressure of water in the first jetting process so that the second water mass is faster than the first water mass, and the prescribed waiting time between the first jetting process and the second jetting process being set so that before the first water mass impinges on the human body, the second water mass having faster velocity than the first water mass overtakes the first water mass to enlarge jetting water cross-sectional area of the first water mass.

2. The apparatus according to claim 1, wherein the pressurizing device varies the pressure of the water so that amount of overtaking by which the previously jetted water is overtaken by the subsequently jetted water in the first jetting process is larger than the amount of overtaking in the second jetting process at the prescribed position from the jetting port.

3. The apparatus according to claim 1, wherein pressure increment of the water per unit time in the second jetting process is larger than pressure increment of the water per unit time in the first jetting process.

4. The apparatus according to claim 1, wherein pressure increment of the water per unit time in second half of the first jetting process is larger than pressure increment of the water per unit time in first half of the first jetting process.

5. The apparatus according to claim 1, wherein in at least part of the first jetting process, the water is jetted from the jetting port in a pressure region below supply water pressure.

6. The apparatus according to claim 5, wherein in at least part of the second jetting process, the water is jetted from the jetting port in a pressure region above the supply water pressure.

7. The apparatus according to claim 5, wherein the pressurizing device includes:

a pressurizer configured to apply pressure to the water; and a pressure accumulator provided between the pressurizer and the jetting port and configured to accumulate the pressure of the water, and part of the pressure applied to the water by the pressurizer in the second jetting process is accumulated in the pressure accumulator, and the accumulated pressure is applied to the water in the first jetting process.

8. The apparatus according to claim 4, wherein the pressurizing device includes:

a pressurizer configured to apply pressure to the water; and a pressure accumulator provided between the pressurizer and the jetting port and configured to accumulate the pressure of the water, and in the first jetting process, at beginning of jetting, the pressure accumulator applies the pressure to the water, and in second half of the first time span in the first jetting process, the pressurizer applies the pressure to the water.

9. The apparatus according to claim 1, wherein the first jetting process and the second jetting process jet water from the single jetting port.

10. The apparatus according to claim 1, wherein the prescribed waiting time is set so that the water subsequently jetted by the second jetting process outstrips the water previously jetted by the first jetting process before impinging on the human body.

* * * * *

UNITED STATES PATENT AND TRADEMARK OFFICE

CERTIFICATE OF CORRECTION

PATENT NO. : 8,272,077 B2
APPLICATION NO. : 13/022071
DATED : September 25, 2012
INVENTOR(S) : Hiroshi Hashimoto et al.

It is certified that error appears in the above-identified patent and that said Letters Patent is hereby corrected as shown below:

In the Specification, column 18 line 51, please add --74-- after the word "device".

Signed and Sealed this
Fourteenth Day of May, 2013

Teresa Stanek Rea
*Acting Director of the United States Patent and Trademark Office*